US011028845B2

(12) United States Patent
Beisel

(10) Patent No.: US 11,028,845 B2
(45) Date of Patent: Jun. 8, 2021

(54) CAVITATION AVOIDANCE SYSTEM

(71) Applicant: Halliburton Energy Services, Inc., Houston, TX (US)

(72) Inventor: Joseph A. Beisel, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 256 days.

(21) Appl. No.: 16/321,964

(22) PCT Filed: Sep. 13, 2016

(86) PCT No.: PCT/US2016/051497

§ 371 (c)(1),
(2) Date: Jan. 30, 2019

(87) PCT Pub. No.: WO2018/052398

PCT Pub. Date: Mar. 22, 2018

(65) Prior Publication Data

US 2019/0178234 A1 Jun. 13, 2019

(51) Int. Cl.

| | |
|---|---|
| ***F04B 49/20*** | (2006.01) |
| ***F04B 23/06*** | (2006.01) |
| ***F04B 47/02*** | (2006.01) |
| ***F04B 49/06*** | (2006.01) |
| ***F04B 11/00*** | (2006.01) |
| ***F15B 21/047*** | (2019.01) |

(52) U.S. Cl.
CPC ..... *F04B 49/20* (2013.01); *F04B 11/0041* (2013.01); *F04B 23/06* (2013.01);
(Continued)

(58) Field of Classification Search
CPC ..... F04B 23/06; F04B 47/02; F04B 49/065; F04B 49/20; F04B 2201/0201;
(Continued)

(56) References Cited

U.S. PATENT DOCUMENTS 5,846,056 A * 12/1998 Dhindsa ..... F04B 23/06 417/44.2
6,487,903 B2 * 12/2002 Sabini ..... F04D 15/0209 417/212

(Continued)

FOREIGN PATENT DOCUMENTS

WO 2007072385 6/2007

OTHER PUBLICATIONS

International Patent Application No. PCT/US2016/051497 , "International Search Report and Written Opinion", May 30, 2017, 21 pages.

*Primary Examiner* — Christopher S Bobish
(74) *Attorney, Agent, or Firm* — Kilpatrick Townsend & Stockton LLP

(57) ABSTRACT

A monitoring system for a plurality of pressure pumps may include, for each pump, a strain gauge, a position sensor and a pressure transducer. A strain gauge may be positionable on each pump to generate a strain measurement corresponding to strain in each pump. A position sensor may be positionable on each pump to generate a position measurement corresponding to a position of a rotating member corresponding of each pump. A pressure transducer is positionable on each pump to generate a boost pressure measurement that is usable with the strain measurement and the position measurement to determine a cavitation threshold for each pump.

20 Claims, 14 Drawing Sheets

(52) U.S. Cl.
CPC ..... *F04B 47/02* (2013.01); *F04B 49/065* (2013.01); *F15B 21/047* (2013.01); *F04B 2201/0201* (2013.01); *F04B 2201/0601* (2013.01); *F04B 2201/1208* (2013.01); *F04B 2205/02* (2013.01); *F04B 2205/03* (2013.01); *F15B 2211/8609* (2013.01)

(58) Field of Classification Search
CPC ..... F04B 2201/0601; F04B 2201/1208; F04B 2205/02; F04B 2205/03; F04B 2211/8609; F04B 21/047; F04B 11/0041
See application file for complete search history.

(56) References Cited

U.S. PATENT DOCUMENTS 6,859,740 B2 * 2/2005 Stephenson ..... F04B 51/00 702/35
6,882,960 B2 * 4/2005 Miller ..... F04B 51/00 702/177
7,623,986 B2 11/2009 Miller
9,255,578 B2 * 2/2016 Sharpe, Jr. ..... F04D 15/0088
10,134,257 B2 * 11/2018 Zhang ..... F04B 49/103
10,247,182 B2 * 4/2019 Zhang ..... F04B 51/00
10,711,787 B1 * 7/2020 Darley ..... F04D 13/02
2004/0117132 A1 6/2004 Stephenson et al.
2007/0140869 A1 * 6/2007 St. Michel ..... F04B 47/00 417/53
2010/0300683 A1 * 12/2010 Looper ..... E21B 21/06 166/250.01
2010/0310384 A1 * 12/2010 Stephenson ..... F04B 49/106 417/53
2012/0055149 A1 * 3/2012 Vonderwell ..... F15B 7/006 60/486
2014/0107952 A1 * 4/2014 Kinoshita ..... G01F 1/74 702/50
2014/0166267 A1 6/2014 Weightman et al.

* cited by examiner

CAVITATION AVOIDANCE SYSTEM

TECHNICAL FIELD

The present disclosure relates generally to pressure pumps for a wellbore and, more particularly (although not necessarily exclusively), to using boost pressure measurements to avoid cavitation in a multiple-pump wellbore system.

BACKGROUND

Pressure pumps may be used in wellbore treatments. For example, hydraulic fracturing (also known as "fracking" or "hydro-fracking") may utilize a pressure pump to introduce or inject fluid at high pressures into a wellbore to create cracks or fractures in downhole rock formations. Due to the high-pressured and high-stressed nature of the pumping environment, pressure pump parts may undergo mechanical wear and require frequent replacement. Frequently changing parts may result in additional costs for the replacement parts and additional time due to the delays in operation while the replacement parts are installed.

DETAILED DESCRIPTION

Figure 1:
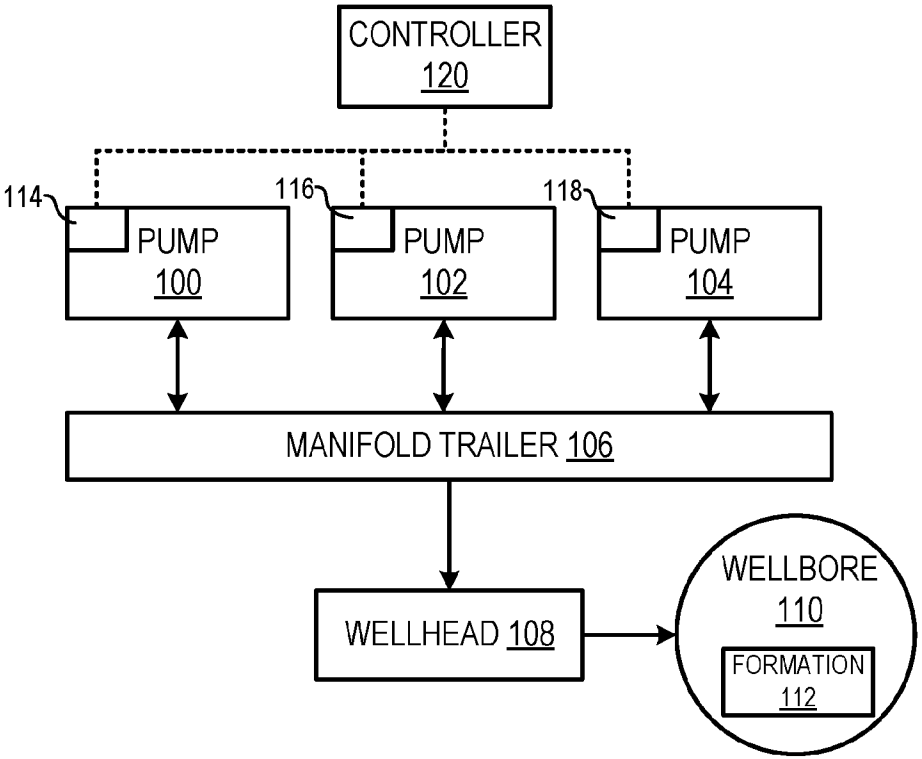
FIG. 1 is a block diagram depicting an example of a multiple-pump wellbore environment according to one aspect of the present disclosure.

Certain aspects and examples of the present disclosure relate to correlating boost pressure of multiple pressure pumps with actuation delays of valves in the chamber to identify a threshold for cavitation in each of the pressure pumps. In some aspects, a monitoring system may rebalance the pump rates of the pumps in the spread to avoid cavitation in a pump having a boost pressure beyond the cavitation threshold. Cavitation may be present in a fluid chamber when pressure in the chamber fluctuate to create a vacuum that turns a portion of the fluid in the chamber into a vapor. Introducing vapor into the chamber may cause the chamber to be incompletely filled by the fluid traversing the pressure pump. The vapors may form small bubbles of gas that may collapse and transmit damaging shock waves through the fluid in the pressure pump. The boost pressure may correspond to the fluid pressure above atmospheric pressure in or near an inlet to the chamber.

In one example, a system may correlate strain in the chamber with the movement of the plunger to determine delays in actuation, or opening and closing, of the valves. The delays may correspond to the amount of fluid entering the chamber as the plunger regresses from the chamber. The system may compare and monitor the actuation delays across each of the chambers to determine a point at which cavitation is present in the chamber, and may identify the minimum boost pressure in a suction (or boost) manifold of the pressure pump at the point to determine a cavitation threshold for the pump. The cavitation threshold may correspond to a boost pressure in a chamber of the pressure pump that is close to, or below, the identified minimum boost pressure.

Boost pressure may be monitored in multiple pressure pumps and pump rate of a pressure pump having a boost pressure beyond a cavitation threshold may be automatically adjusted to avoid cavitation in the pump. To maintain a constant flow rate of fluid into and out of a manifold trailer fluidly coupled to the pressure pumps, the pressure pump may also adjust the pump rate of one or more other pressure pumps in an opposing direction (e.g., lower the pump rate of a second pump where the pump rate of a first pump is raised). A system may monitor the pressure pumps to determine if the pressure pump beyond the cavitation threshold is improving. For example, the system may monitor the pressure pump beyond the cavitation threshold to determine whether the boost pressure or valve actuation delays indicate less or no cavitation in the fluid chamber. The system may continue adjustments to the pump rates of the pressure pumps in the same direction subsequent to indications of an improvement. The system may reverse the adjustments to the pressure pumps subsequent to indications that the pressure pump beyond the cavitation threshold is not improving.

A system according to some aspects of the present disclosure may reduce or prevent cavitation in the pressure pumps of a wellbore environment in real-time during pumping operations in a wellbore. Cavitation in a pressure pump may cause significant damage to the pressure pump. The damage may result in costly repairs to components of the pressure pump and significant delays in pumping operations while such repairs are implemented. Identifying conditions for potential cavitation and adjusting pump rates to avoid cavitation in the pressure pumps may result in significant cost-savings in parts and labor.

These illustrative examples are provided to introduce the reader to the general subject matter discussed here and are not intended to limit the scope of the disclosed concepts. The following sections describe various additional aspects and examples with reference to the drawings in which like numerals indicate like elements, and directional descriptions are used to describe the illustrative examples but, like the illustrative examples, should not be used to limit the present disclosure. The various figures described below depict examples of implementations for the present disclosure, but should not be used to limit the present disclosure.

Various aspects of the present disclosure may be implemented in various environments. For example, FIG. 1 is a cross-sectional schematic diagram depicting an example of a multiple-pump wellbore environment according to one aspect of the present disclosure. The wellbore environment includes pressure pumps 100, 102, 104. Although three pumps 100, 102, 104 are shown in the wellbore environment of FIG. 1, two pressure pumps or more than three pressure pumps may be included without departing from the scope of the present disclosure. In some aspects, the pumps 100, 102, 104 may include any type of positive displacement pressure pump. The pumps 100, 102, 104 are each fluidly connected to a manifold trailer 106. In some aspects, the pumps 100, 102, 104 may include one or more flow lines, or sets of fluid pipes, to allow fluid to flow from the manifold trailer 106 into the pumps 100, 102, 104 and to flow fluid out of the pumps 100, 102, 104 and into the manifold trailer 106. In some aspects, the manifold trailer 106 may include a truck or trailer including one or more pump manifolds for receiving, organizing, or distributing wellbore servicing fluids during wellbore operations (e.g., fracturing operations). In some aspects, fluid from a first pump manifold of the manifold trailer 106 may enter the pumps 100, 102, 104 at a low pressure. The fluid may be pressurized in the pumps 100, 102, 104 and may be discharged from the pumps 100, 102, 104 into a second pump manifold of the manifold trailer 106 at a high pressure.

The fluid in the first pump manifold of the manifold trailer 106 may include fluid having various concentrations of chemicals to perform specific operations in the wellbore environment. For example, the fluid may include proppant or other additives for a fracturing operation. The fluid in the second pump manifold of the manifold trailer 106 may discharge the fluid having the proppant or additives to a wellhead 108 via a feed line extending from an outlet of the manifold trailer 106 to the wellhead 108. The wellhead 108 may be positioned proximate to a surface of a wellbore 110. The fluid discharged from the manifold trailer 106 may be pressurized by the pumps 100, 102, 104 and injected to generate fractures in subterranean formations 112 downhole and adjacent to the wellbore 110.

A monitoring system may be included in the wellbore environment to control the operations of the pumps 100, 102, 104. The monitoring system includes subsystems 114, 116, 118 for each of the pumps 100, 102, 104, respectively. The subsystems 114, 116, 118 may monitor operational characteristics of the pumps 100, 102, 104. In some aspects, each of the subsystems 114, 116, 118 may include monitoring devices to monitor, record, and communicate the operational characteristics of the pump. In additional and alternative aspects, the subsystems 114, 116, 118 may include a processing device or other processing means to perform adjustments to the pump. For example, the 114, 116, 118 may adjust a pump rate to change the flow rate of fluid through a pump 100, 102, 104 by modifying the speed at the crankshaft 208, causing the plunger 214 to displace fluid in the chamber 206 of the pump 100, 102, 104. In some aspects, the subsystems 114, 116, 118 may transmit information corresponding to the pumps 100, 102, 104 to a controller 120. In some aspects, the controller 120 may include a processing device or other processing means for receiving and processing information from the pumps 100, 102, 104, collectively. The controller 120 may transmit control signals to the pumps 100, 102, 104 to maintain a desired operation of a wellbore operation. For example, the controller 120 may determine that a flow rate of the pump 100 must be adjusted and transmit a signal to cause the subsystem 114 to adjust the pump rate of the pump 100 accordingly. Although separate subsystems 114, 116, 118 are described, the pumps 100, 102, 104 may be directly connected to a single controller device without departing from the scope of the present disclosure.

Figure 2:
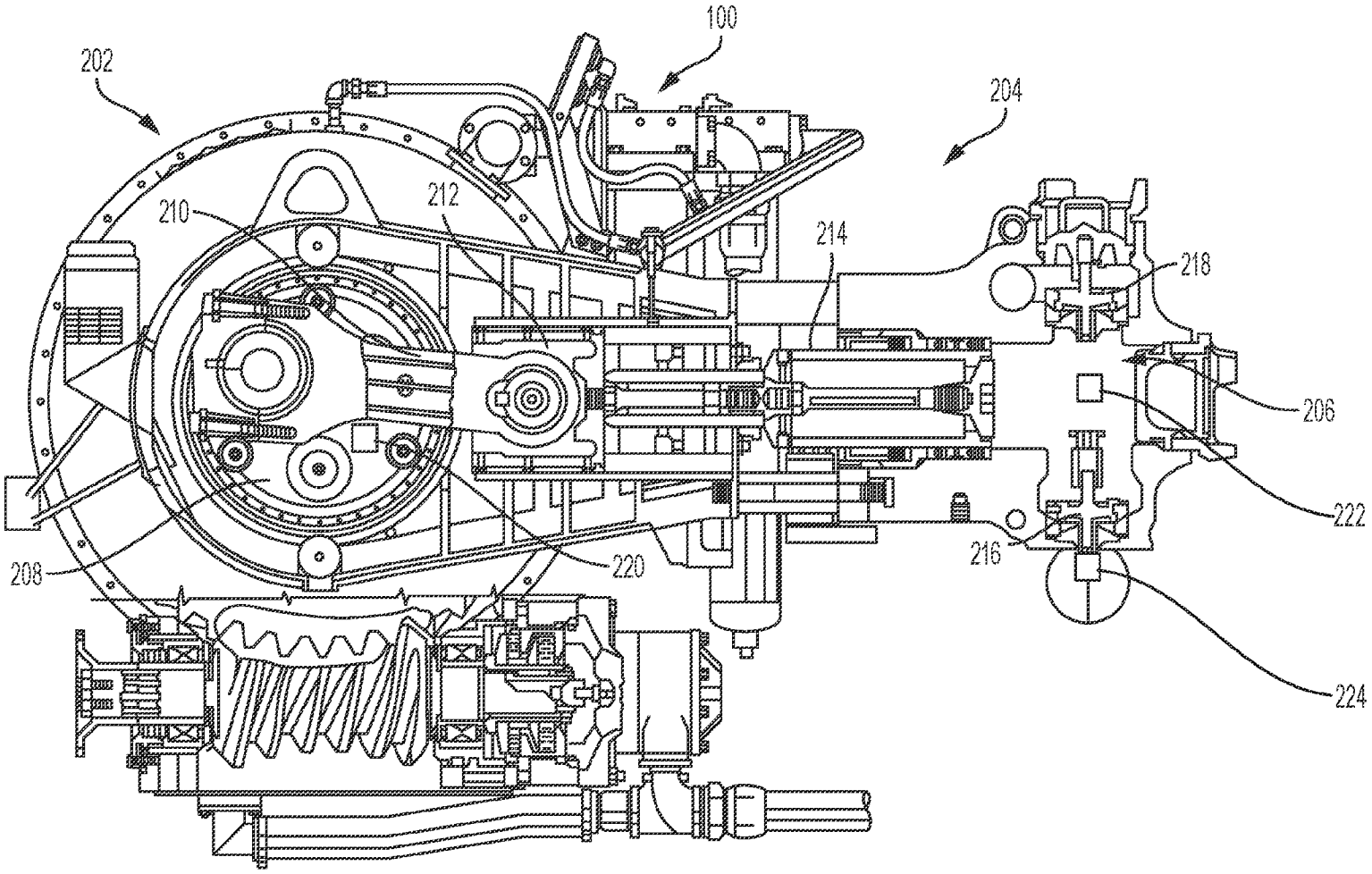
FIG. 2 is a cross-sectional schematic diagram depicting an example of a pressure pump of the wellbore environment of FIG. 1 according to one aspect of the present disclosure.

FIG. 2 is a cross-sectional schematic diagram depicting an example of the pump 100 of the wellbore environment of FIG. 1 according to one aspect of the present disclosure. Although pump 100 is described in FIG. 2, pump 100 may represent any of the pumps 100, 102, 104 of FIG. 1. The pump 100 includes a power end 202 and a fluid end 204. The power end 202 may be coupled to a motor, engine, or other prime mover for operation. The fluid end 204 includes at least one chamber 206 for receiving and discharging fluid flowing through the pump 100. Although FIG. 2 shows one chamber 206 in the pump 100, the pump 100 may include any number of chambers 206 without departing from the scope of the present disclosure.

The pump 100 also includes a rotating assembly in the power end 202. The rotating assembly includes a crankshaft 208, a connecting rod 210, a crosshead 212, a plunger 214, and related elements (e.g., pony rods, clamps, etc.). The crankshaft 208 may be mechanically connected to the plunger 214 in the chamber 206 of the pressure pump via the connecting rod 210 and the crosshead 212. The crankshaft 208 may cause the plunger 214 for the chamber 206 to displace any fluid in the chamber 206 in response to the plunger moving within the chamber 206. In some aspects, a pump 100 having multiple chambers may include a separate plunger for each chamber. Each plunger may be connected to the crankshaft of the plunger via a respective connecting rod and crosshead. The chamber 206 includes a suction valve 216 and a discharge valve 218 for absorbing fluid into the chamber 206 and discharging fluid from the chamber 206, respectively. The fluid may be absorbed into and discharged from the chamber 206 in response to the plunger 214 moving. Based on the mechanical coupling of the crankshaft 208 to the plunger 214, the movement of the plunger 214 may be directly related to the movement of the crankshaft 208.

In some aspects, the suction valve 216 and the discharge valve 218 may be passive valves. As the plunger 214 operates in the chamber 206, the plunger 214 may impart motion and pressure to the fluid by direct displacement. The suction valve 216 and the discharge valve 218 may open and close based on the displacement of the fluid in the chamber 206 by the plunger 214. For example, during decompression of the pressure pump 100, the suction valve 216 may be opened when the plunger 214 recesses to absorb fluid from outside of the chamber 206 into the chamber 206. As the plunger 214 regresses from the chamber 206, the plunger 214 may create a partial suction to open the suction valve 216 and allow fluid to enter the chamber 206. In some aspects, the fluid may be absorbed into the chamber 206 from an intake manifold. Fluid already in the chamber 206 may move to fill the space where the plunger 214 was located in the chamber 206. The discharge valve 218 may be closed during this process.

During compression of the pressure pump 100, the discharge valve 218 may be opened as the plunger 214 moves forward or reenters the chamber 206. As the plunger 214 moves further into the chamber 206, the fluid may be pressurized. The suction valve 216 may be closed during this time to allow the pressure on the fluid to force the discharge valve 218 to open and discharge fluid from the chamber 206. In some aspects, the discharge valve 218 may discharge the fluid into an output manifold. The loss of pressure inside the chamber 206 may allow the discharge valve 218 to close and the load cycle may restart. Together, the suction valve 216 and the discharge valve 218 may operate to provide the fluid flow in a desired direction. A measurable amount of pressure and stress may be present in the chamber 206 during this process, such as the stress resulting in strain to the chamber 206 or fluid end 204 of the pump 100.

In some aspects, the pump 100 may include one or more measurement devices positioned on the pump 100 to obtain measurements of the pump 100. For example, the pump 100 includes a position sensor 220, a strain gauge 222, and a pressure transducer 224 positioned on the pump 100. The position sensor 220 is positioned on the power end 202 of the pump 100 to sense the position of the crankshaft 208 or another rotating component of the pump 100. In some aspects, the position sensor 220 is positioned on an external surface of the power end 202 (e.g., on a surface of a crankcase for the crankshaft 208) to determine a position of the crankshaft 208. The strain gauge 222 and the pressure transducer are positioned on the fluid end 204 of the pressure pump 100. The strain gauge 222 is positioned on the fluid end 204 to measure the strain in the chamber 206. In some aspects, the strain gauge 222 may be positioned on an external surface of the fluid end 204 (e.g., on an outer surface of the chamber 206) to measure strain in the chambers 206 without creating a puncturing or other opening in the fluid end 204. The pressure transducer 224 is positioned on the fluid end 204 to measure pressure in the fluid end 204 of the pressure pump 100. In some aspects, the pressure transducer 224 may be positioned at an inlet to the chamber 206, proximate to the suction valve 216.

Figure 3:
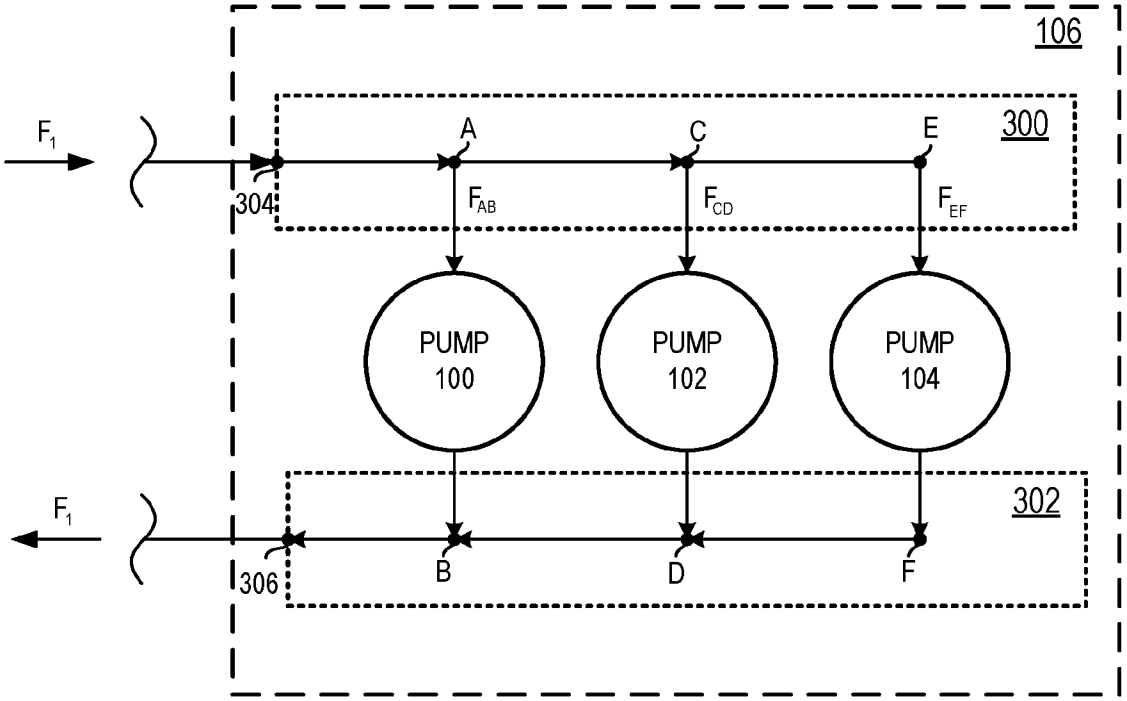
FIG. 3 is a block diagram depicting a manifold trailer of the wellbore environment of FIG. 1 according to one aspect of the present disclosure.

FIG. 3 is a block diagram depicting an example of the manifold trailer 106 of the wellbore environment of FIG. 1. The pumps 100, 102, 104 are fluidly connected in parallel between an intake manifold 300 and an output manifold 302 of the manifold trailer 106. The intake manifold 300 may include an inlet 304 connected to a common flow line fluidly connecting the pumps 100, 102, 104 to a fluid tank, blender, or other fluid source for providing fluid to the pressure pumps 100, 102, 104. The output manifold 302 may include an outlet 306 connected to a common flow line fluidly connecting the pumps 100, 102, 104 to a fluid destination, such as the wellhead 108 of FIG. 1. The intake manifold 300 and the output manifold 302 include junctions A-F that allow fluid to flow from the fluid source to the pumps 100, 102, 104 and from the pumps 100, 102, 104 to the fluid destination. The junctions A, C, E correspond to the point where the flow of fluid from the fluid source travels through a common flow line and splits into two flows through separate pipes. The junctions B, D, F correspond to the point where the flow of fluid from the pumps 100, 102, 104 combines into a single flow through a common flow line to the fluid destination.

The flow rate in each pipe segment connecting the intake manifold 300 to the output manifold 302 is denoted by the variable $F_xy$, where the subscript "X" represents the source junction and the subscript "Y" represents the destination junction. For example, the variable $F_{AB}$ corresponds to a flow rate from the junction A to the junction B through the pump 100. The variable $F_{CD}$ corresponds to a flow rate from the junction C to the junction D through the pump 102. The variable $F_{EF}$ corresponds to a flow rate from the junction E to the junction F through the pump 104. During a fracturing operation in the wellbore environment, the flow rate into the manifold trailer 106 and the flow rate out of the manifold trailer 106 may be the same, as denoted by the variable $F_1$. The flow rates $F_{AB}$, $F_{CD}$, $F_{EF}$ corresponding to the flow of fluid through the pumps 100, 102, 104, respectively, denote that the respective flow rate into the pump 100, 102, 104 is the same as the flow rate coming out of the pump. This characterization of the flow rate through the pumps 100, 102, 104 may assume that each of the pumps 100, 102, 104 is operating at 100% efficiency.

Figure 4:
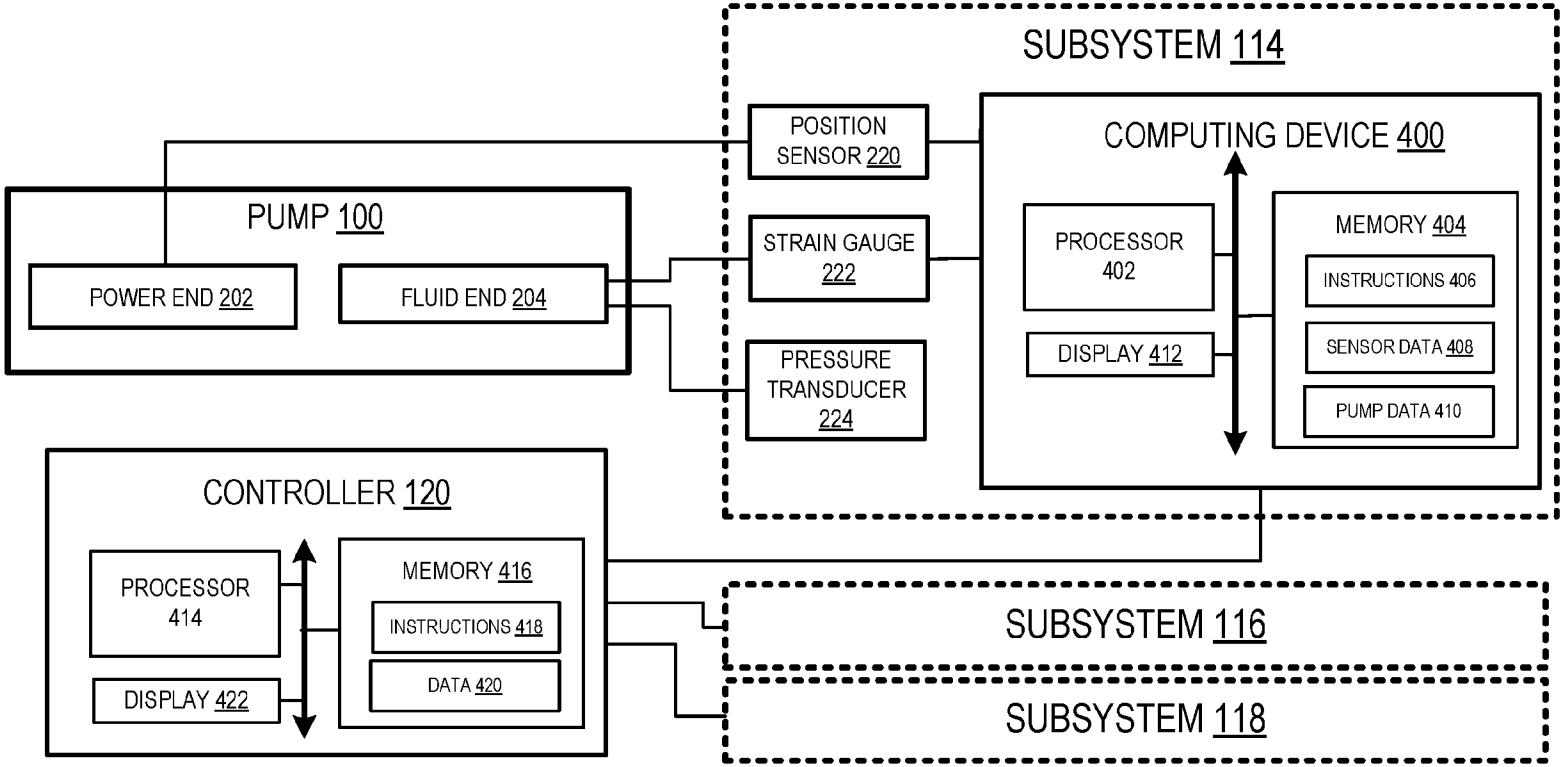
FIG. 4 is a block diagram depicting a monitoring system of FIG. 1 according to one aspect of the present disclosure.

FIG. 4 is a block diagram depicting the monitoring system of FIG. 1 according to one aspect of the present disclosure. In some aspects, the monitoring system of FIG. 4 may include a computing device 400 including one or more components that may be included in each of the subsystems 114, 116, 118 of FIG. 1. The subsystem 114 for the pump 100 includes the position sensor 220, the strain gauge 222, and the pressure transducer 224 communicatively coupled to the pump 100. The subsystems 116, 118 may also include respective measurement devices for the pumps 102, 104, respectively.

The position sensor 220 may include a magnetic pickup sensor capable of detecting ferrous metals in close proximity. In some aspects, the position sensor 220 may be positioned on the power end 202 of the pressure pump to determine the position of the crankshaft 208. In some aspects, the position sensor 220 may be placed proximate to a path of the crosshead 212. The path of the crosshead 212 may be directly related to a rotation of the crankshaft 208. The position sensor 220 may sense the position of the crankshaft 208 based on the movement of the crosshead 212. In other aspects, the position sensor 220 may be placed directly on a crankcase of the power end 202 as illustrated by position sensor 220 in FIG. 2. The position sensor 220 may determine a position of the crankshaft 208 by detecting a bolt pattern of the crankshaft 208 as the crankshaft 208 rotates during operation of the pump 100. The position sensor 220 may generate a signal representing the position of the crankshaft 208 and transmit the signal to the computing device 400.

The strain gauge 222 may be positioned on the fluid end 204 of the pump 100. Non-limiting examples of types of strain gauges include electrical resistance strain gauges, semiconductor strain gauges, fiber optic strain gauges, micro-scale strain gauges, capacitive strain gauges, vibrating wire strain gauges, etc. In some aspects, a strain gauge 222 may be included for each chamber 206 of the pump 100 (e.g., where pump 100 is a multiple-chamber pressure pump) to determine strain in each of the chambers 206, respectively. In some aspects, the strain gauge 222 may be positioned on an external surface of the fluid end 204 of the pump 100 in a position subject to strain in response to stress in the chamber 206. For example, the strain gauge 222 may be positioned on a section of the fluid end 204 in a manner such that when the chamber 206 loads up, strain may be present at the location of the strain gauge 222. This location may be determined based on engineering estimations, finite element analysis, or by some other analysis. The analysis may determine that strain in the chamber 206 may be directly over a plunger bore of the chamber 206 during load up. The strain gauge 222 may be placed on an external surface of the pump 100 in a location directly over the plunger bore corresponding to the chamber 206 as illustrated by strain gauge 222 in FIG. 2 to measure strain in the chamber 206. The strain gauge 222 may generate a signal representing strain in the chamber 206 and transmit the signal to the computing device 400.

The pressure transducer 224 may be positioned on the fluid end 204 of the pump 100. In some aspects, the pressure transducer 224 may include a boost gauge, a pressure gauge, a high-speed pressure sensor, or measurement device for measuring air pressure. In some aspects, the pressure transducer 224 may be positioned at an inlet to the chamber 206 to determine pressure in the intake manifold 300 of FIG. 3 or in the chamber 206. In additional and alternative aspects, the pressure transducer 224 may include a filter or other capabilities for processing differentials in the pressure measurements obtained by the pressure transducer 224. For example, the pressure transducer 224 may include the envelope filter may be a low-enveloping filter that may generate a minimum or maximum suction pressure reading from a pressure signal generated by the pressure transducer 224. In other aspects, the enveloping filter may be integral or accessible to the computing device The computing device 400 may be coupled to the position sensor 220, the strain gauge 222, and the pressure transducer 24 to receive the respective signals from each. The computing device 400 includes a processor 402, a memory 404, and a display unit 412. In some aspects, the processor 402, the memory 404, and the display unit 412 may be communicatively coupled by a bus. The processor 402 may execute instructions 406 for monitoring the pump 100, determining cavitation conditions in the pump 100, and controlling certain operations of the pump 100. The instructions 406 may be stored in the memory 404 coupled to the processor 402 by the bus to allow the processor 402 to perform the operations. The processor 402 may include one processing device or multiple processing devices. Non-limiting examples of the processor 402 may include a Field-Programmable Gate Array ("FPGA"), an application-specific integrated circuit ("ASIC"), a microprocessor, etc. The non-volatile memory 404 may include any type of memory device that retains stored information when powered off. Non-limiting examples of the memory 404 may include electrically erasable and programmable read-only memory ("EEPROM"), a flash memory, or any other type of non-volatile memory. In some examples, at least some of the memory 404 may include a medium from which the processor 402 can read the instructions 406. A computer-readable medium may include electronic, optical, magnetic, or other storage devices capable of providing the processor 402 with computer-readable instructions or other program code (e.g., instructions 406). Non-limiting examples of a computer-readable medium include (but are not limited to) magnetic disks(s), memory chip(s), ROM, random-access memory ("RAM"), an ASIC, a configured processor, optical storage, or any other medium from which a computer processor can read the instructions 406. The instructions 406 may include processor-specific instructions generated by a compiler or an interpreter from code written in any suitable computer-programming language, including, for example, C, C++, C#, etc.

In some examples, at least some of the memory 404 may include a medium from which the processor 402 can read the instructions 406. In some examples, the computing device 400 may determine an input for the instructions 406 based on sensor data 408 from the position sensor 220, the strain gauge 222, the pressure transducer 224, data input into the computing device 400 by an operator, or other input means. For example, the position sensor 220 or the strain gauge 222 may measure a parameter (e.g., the position of the crankshaft 208, strain in the chamber 206) associated with the pump 100 and transmit associated signals to the computing device 400. The computing device 400 may receive the signals, extract data from the signals, and store the sensor data 408 in memory 404.

In additional aspects, the computing device 400 may determine an input for the instructions 406 based on pump data 410 stored in the memory 404. In some aspects, the pump data 410 may be stored in the memory 404 in response to previous determinations by the computing device 400. For example, the processor 402 may execute instructions 406 to cause the processor 402 to perform pump-monitoring tasks related to the pump rate of the pump 100, or the flow rate of fluid through the pump 100. The processor 402 may store flow-rate information that is received during monitoring of the pump 100 as pump data 410 in the memory 404 for further use (e.g., calibrating the pressure pump). In additional aspects, the pump data 410 may include other known information, including, but not limited to, the position of the position sensor 220 or the strain gauge 222 in or on the pump 100. For example, the computing device 400 may use the position of the position sensor 220 on the power end 202 of the pump 100 to interpret the position signals received from the position sensor 220 (e.g., as a bolt pattern signal).

In some aspects, the computing device 400 may generate graphical interfaces associated with the sensor data 408 or pump data 410, and information generated by the processor 402 therefrom, to be displayed via a display unit 412. The display unit 412 may be coupled to the processor 402 and may include any CRT, LCD, OLED, or other device for displaying interfaces generated by the processor 402. In some aspects, the computing device 400 may also generate an alert or other communication of the performance of the pump 100 based on determinations by the computing device 400 in addition to, or instead of, the graphical interfaces. For example, the display unit 412 may include audio components to emit an audible signal when certain conditions are present in the pump 100 (e.g., when the efficiency of one of the pumps 100, 102, 104 of FIG. 1 is compromised).

The computing device 400 for each of the subsystems 114, 116, 118 is communicatively coupled to the controller 120. The controller 120, similar to the computing device includes a processor 414, a memory 416, and a display 422. The processor 414 and the memory 416 may be similar in type and operation to the processor 402 and the memory 404 of the computing device 400. The processor 414 may execute instructions 418 stored in the memory 416 for receiving and processing information received from the subsystems 114, 116, 118. In some examples, at least some of the memory 416 may include a medium from which the processor 414 can read the instructions 418. In additional aspects, the processor 414 may determine an input for the instructions 418 based on data 420 stored in the memory 416. In some aspects, the data 420 may be stored in the memory 416 in response to previous determinations by the controller 120. For example, the processor 414 may execute instruction 418 to cause the processor 414 to determine whether a pump is operating beyond a cavitation threshold. In another example, the processor 414 may execute instructions 418 to cause the processor 414 to analyze and determine pump rates for the pumps 100, 102, 104. The processor 414 may also transmit control signals to the subsystems 116, 118, 118 to adjust the operations of the pumps 100, 102, 104.

Figure 5:
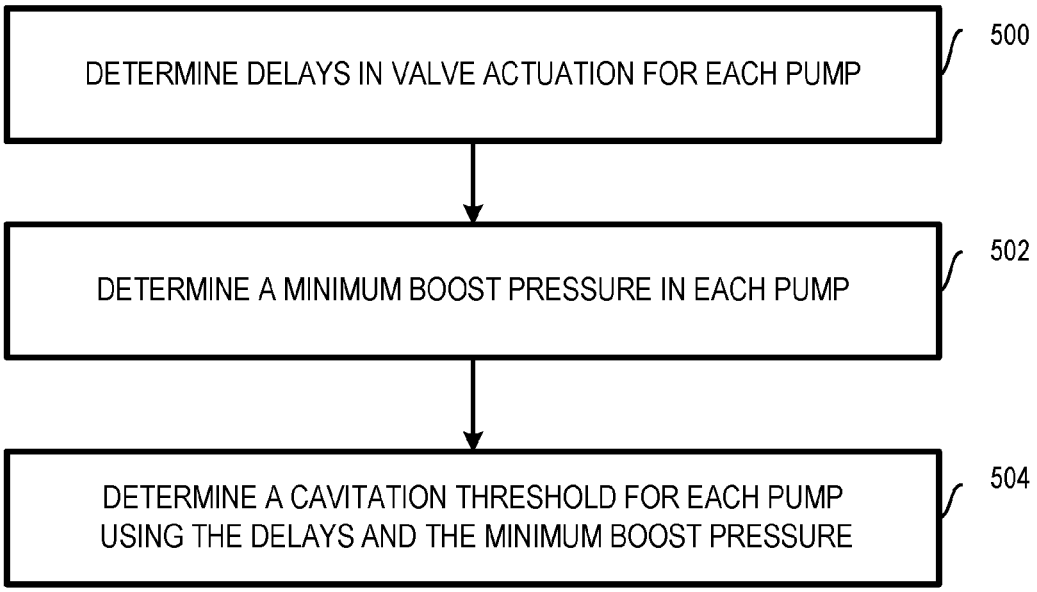
FIG. 5 is a flow chart of an example of a process for determining a cavitation threshold according to one aspect of the present disclosure.

FIG. 5 is a flow chart of an example of a process for determining a cavitation threshold for each of the pressure pumps 100, 102, 104 according to one aspect of the present disclosure. The process is described with respect to FIGS. 1-4, though other implementations are possible without departing from the scope of the present disclosure.

In block 500, delays in the actuation (e.g., the opening and the closing) of the valves 216, 218 are determined. In some aspects, the delays may correspond to the difference in time between the actual opening or closing of the valves 216, 218 and the expected opening and closing of the valves 216, 218 in light of the position of the plunger 214 in the chamber 206.

In block 502, a minimum boost pressure is determined in each pump. In some aspects, boost pressure may correspond to the pressure at the inlet of the chamber 206 (e.g., proximate to the suction valve 216). The boost pressure may represent the pressure in the chamber 206 during the compression of the pump 100 (e.g., during the time interval between actuation points 902, 904 when the suction valve 216 is in an open position). A boost pressure measurement during operation of the pump 100 may be dynamic since the mechanical components of the pressure pump near the inlet to the chamber 206 are constantly in motion.

In block 504, a cavitation threshold is determined for each pump 100, 102, 104 using the actuation delays corresponding to the valves 216, 218 and a minimum boost pressure of each pump 100, 102, 104. In some aspects, the cavitation threshold may correspond to a threshold of a boost pressure measurement in each pump that may indicate cavitation conditions. In some aspects, the cavitation conditions may include actual cavitation in the pump. In other aspects, the cavitation conditions may include conditions close to cavitation in the pump. For example, a point of actual cavitation may be determined and a cavitation threshold may include conditions within a predetermined range of the point of actual cavitation.

Figure 6:
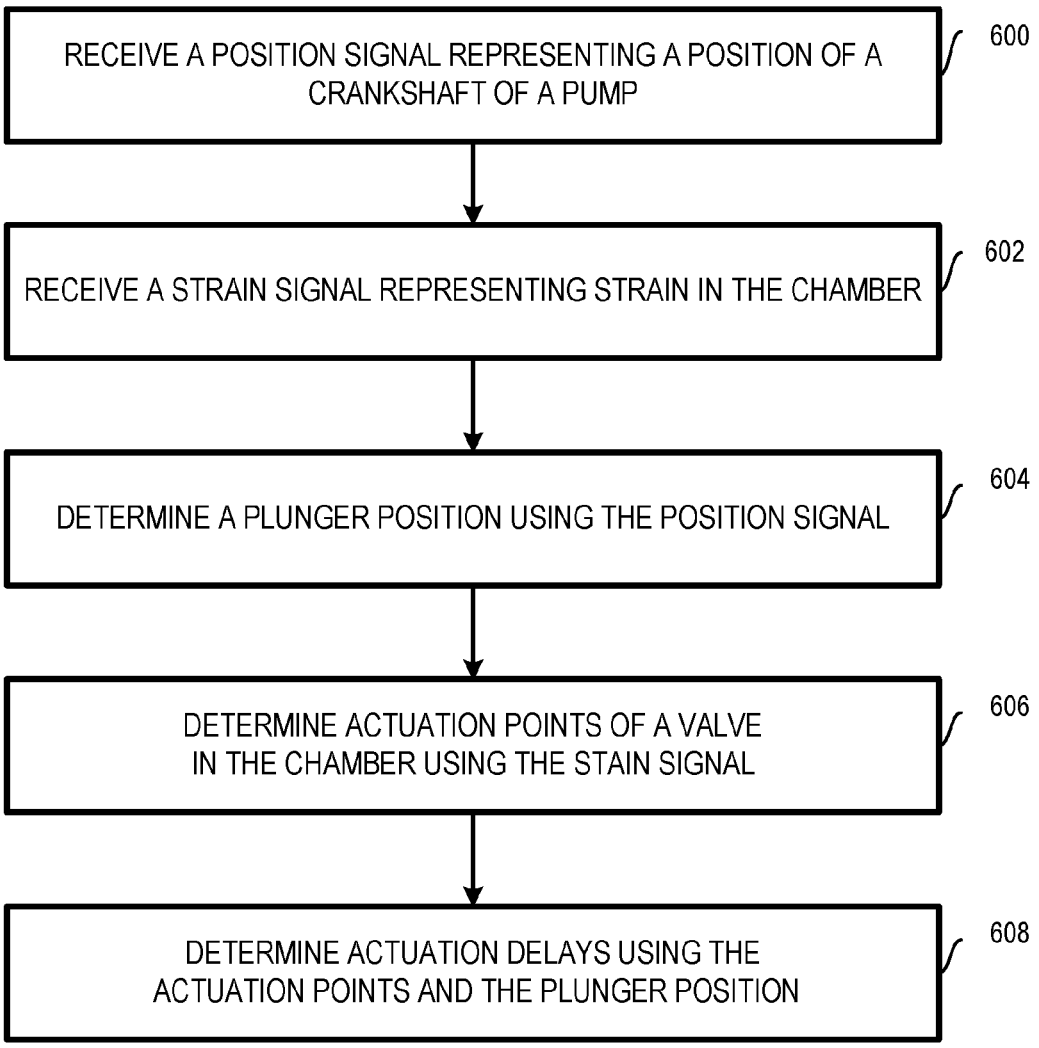
FIG. 6 is a flow chart of an example of a process for determining delays in the actuation of valves in a pressure pump of FIG. 1 according to one aspect of the present disclosure.

FIG. 6 is a flow chart of an example of a process for determining delays in the actuation of the valves 216, 218 in the pressure pumps 100, 102, 104 as described in block 500 of FIG. 5. The process is described with respect to pump 100, but may be similarly performed for each of the pumps 100, 102, 104.

In block 600, a position signal representing a position of the crankshaft 208 of the pump 100 is received. In some aspects, the position signal may be received by the computing device 400 of the subsystem 114 connected to the pump 100. The position signal may be generated by the position sensor 220 and correspond to the position of a rotating component of a rotating assembly that is mechanically coupled to the plunger 214. For example, the position sensor 220 may be positioned on a crankcase of the crankshaft 208 to generate signals corresponding to the position, or rotation, of the crankshaft 208.

In block 602, a strain signal representing strain in the chamber 206 of the pump 100 is received. In some aspects, the strain signal may be generated by the strain gauge 222 and received by the computing device 400.

Figure 7:
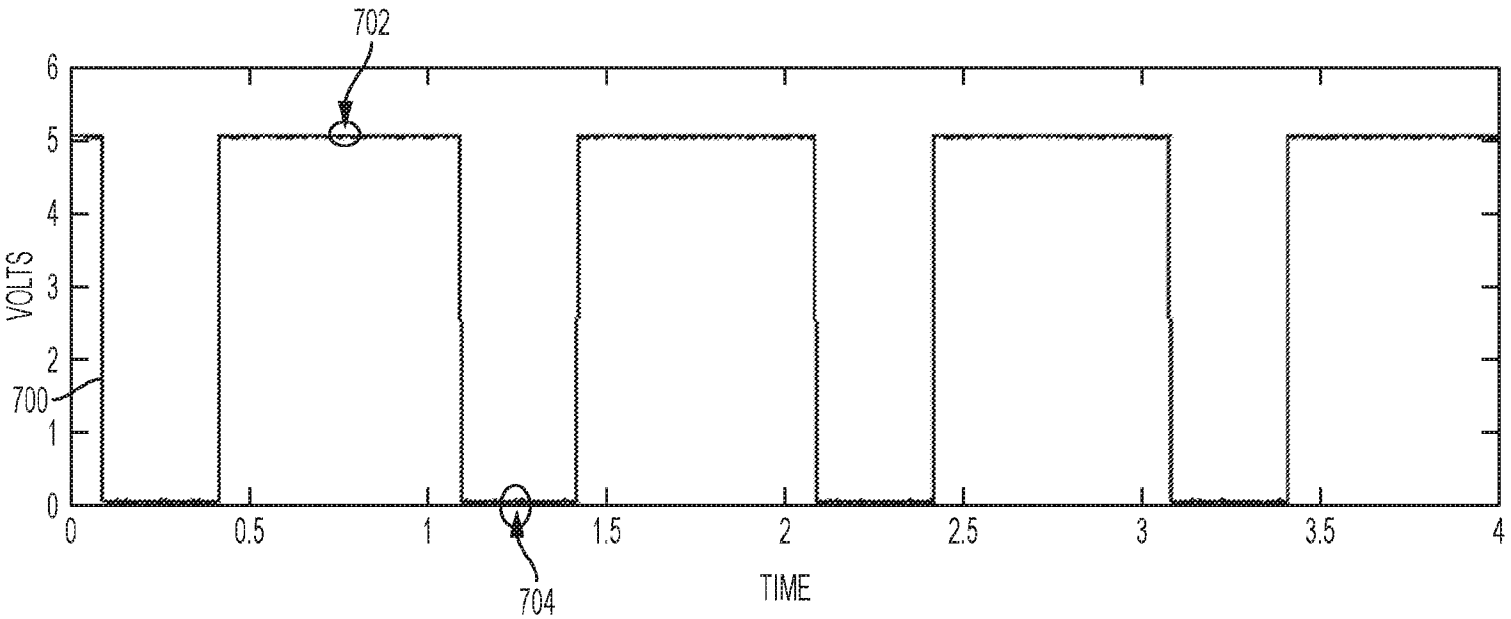
FIG. 7 is a signal graph depicting an example of a signal generated by a position sensor of the monitoring system of FIG. 4 according to one aspect of the present disclosure.
Figure 8:
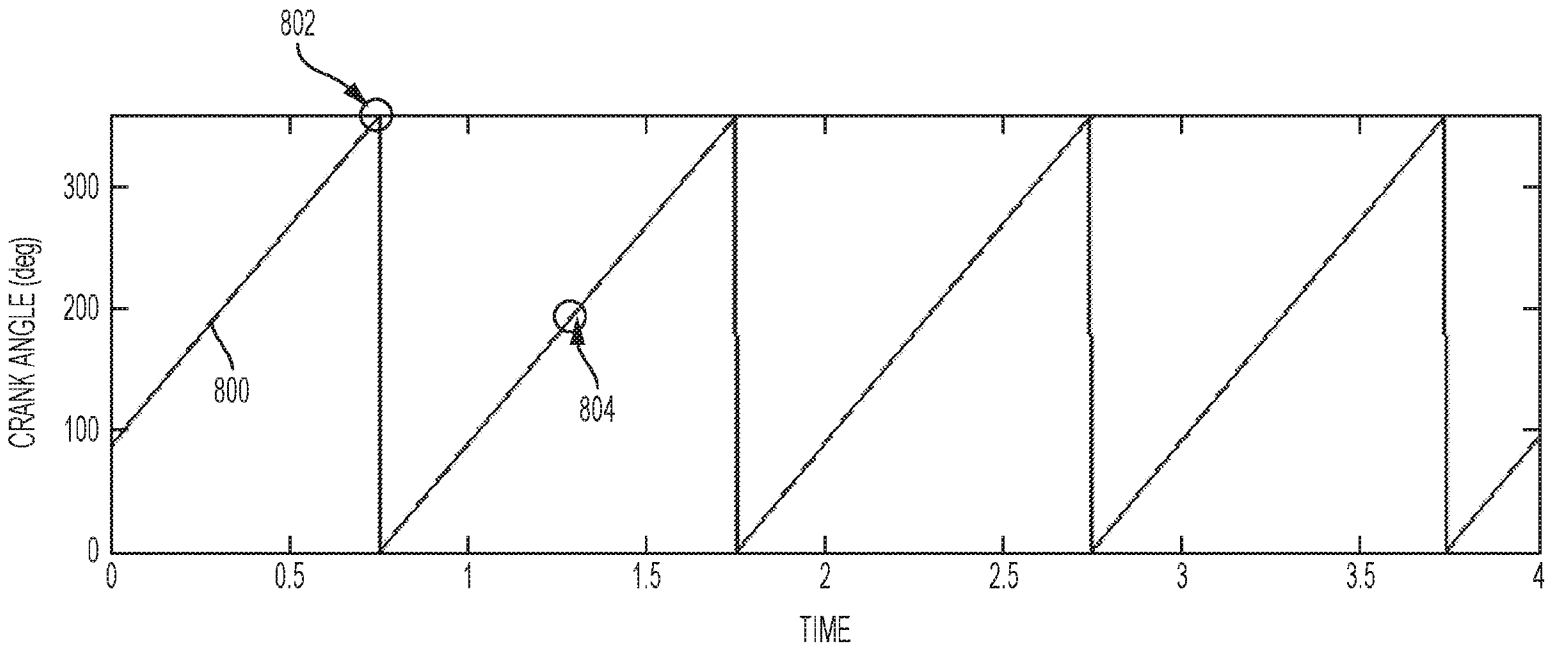
FIG. 8 is a signal graph depicting an example of another signal generated by a position sensor of the monitoring system of FIG. 4 according to one aspect of the present disclosure.

In block 604, a position of the plunger 214 is determined using the position signal received in block 600. FIGS. 7 and 8 show examples of position signals 700, 800 that may be generated by the position sensor 220 during operation of the pump 100 according to some aspects of the present disclosure. In some aspects, the position signals 700, 800 may represent the position of the crankshaft 208, which is mechanically coupled to the plunger 214. FIG. 8 shows a position signal 700 displayed in volts over time (in seconds). The position signal 700 may be generated by the position sensor 220 coupled to the power end 202 of the pump 100 and positioned in a path of the crosshead 212. The position signal 700 may represent the position of the crankshaft 208 over the indicated time as the crankshaft 208 operates to cause the plunger 214 to move within the chamber 206. The mechanical coupling of the plunger 214 to the crankshaft 208 may allow the computing device to determine a plunger position relative to the position of the crankshaft based on the position signal 700.

In some aspects, the computing device 400 may determine plunger-position reference points 702, 704 based on the position signal 700. For example, the processor 402 may determine dead center positions of the plunger 214 based on the position signal 700. The dead center positions may include the position of the plunger 214 in which it is farthest from the crankshaft 208, known as the top dead center. The dead center positions may also include the position of the plunger 214 in which it is nearest to the crankshaft 208, known as the bottom dead center. The distance between the top dead center and the bottom dead center may represent the length of a full pump stroke of the plunger 214 operating in the chamber 206. The position signal between the top dead center and the bottom dead center may represent the movement of the crankshaft 208 during a full stroke of the plunger 214 in the chamber 206. In FIG. 7, the top dead center is represented by reference point 702 and the bottom dead center is represented by reference point 704. In some aspects, the processor 402 may determine the reference points 702, 704 by correlating the position signal 700 with a known ratio or other expression or relationship value representing the relationship between the movement of the crankshaft 208 and the movement of the plunger 214. For example, the mechanical correlations of the crankshaft 208 to the plunger 214 based on the mechanical coupling of the crankshaft 208 to the plunger 214 in the pump 100). The computing device 400 may determine the top dead center and bottom dead center based on the position signal 700 or may determine other plunger-position reference points to determine the position of the plunger over a full stroke of the plunger 214, or a pump cycle of the pump 100, relative to the position of the crankshaft 208.

FIG. 8 shows a position signal 800 displayed in degrees over time (in seconds) according to some aspects of the present disclosure. The degree value may represent the rotational angle of the crankshaft 208 during operation of the crankshaft 208 or pump 100. In some aspects, the position signal 800 may be generated by the position sensor 220 located directly on the power end 202 (e.g., positioned directly on the crankshaft 208 or a crankcase of the crankshaft 208). The position sensor 220 may generate the position signal 800 based on the bolt pattern of the crankshaft 208 or other suitable target as the position sensor 220 rotates in response to the rotation of the crankshaft 208 during operation. Similar to the position signal 700 shown in FIG. 7, the computing device 400 may determine plunger-position reference points 802, 804 based on the position signal 800. The reference points 802, 804 represent the top dead center and bottom dead center of the plunger 214 for the chamber 206 during operation of the pump 100.

Figure 9:
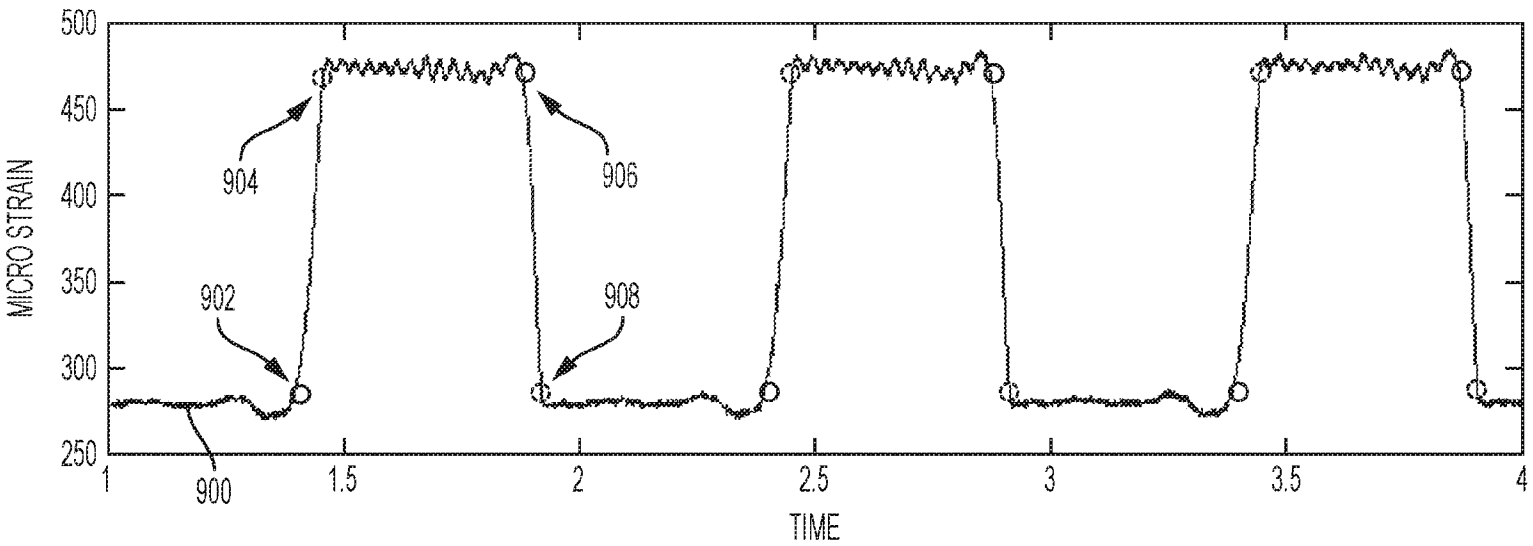
FIG. 9 is a signal graph depicting an example of a signal generated by a strain gauge of the monitoring system of FIG. 4 according to one aspect of the present disclosure.

Returning to FIG. 6, in block 606, actuation points of the suction valve 216 and the discharge valve 218 are determined using the strain signal. The actuation points may represent the point in time where the suction valve 216 and the discharge valve 218 open and close. FIG. 9 shows an example of a strain signal 900 that may be generated by the strain gauge 222 according to some aspects of the present disclosure. In some aspects, the computing device 400 may determine actuation points 902, 904, 906, 908 of the suction valve 216 and the discharge valve 218 for the chamber 206 based on the strain signal 900. For example, the computing device 400 may execute instructions 406 including signal-processing processes for determining the actuation points 902, 904, 906, 908. The computing device 400 may execute instruction 406 to determine the actuation points 902, 904, 906, 908 by determining discontinuities in the strain signal 900. In some aspects, the stress in the chamber 206 may change during the operation of the suction valve 216 and the discharge valve 218 to cause the discontinuities in the strain signal 900 during actuation of the valves 216, 218. The computing device 400 may identify these discontinuities as the opening and closing of the valves 216, 218.

In one example, the strain in the chamber 206 may be isolated to the fluid in the chamber 206 when the suction valve 216 is closed. The isolation of the strain may cause the strain in the chamber 206 to load up until the discharge valve 218 is opened. When the discharge valve 218 is opened, the strain may level until the discharge valve 218 is closed, at which point the strain may unload until the suction valve 216 is reopened. The discontinuities may be present when the strain signal 900 shows a sudden increase or decrease in value corresponding to the actuation of the valves 216, 218. Actuation point 902 represents the suction valve 216 closing, actuation point 904 represents the discharge valve 218 opening, actuation point 906 represents the discharge valve 218 closing, and actuation point 908 represents the suction valve 216 opening to resume the cycle of fluid into and out of the chamber 206. The exact magnitudes of strain or pressure in the chamber 206 determined by the strain gauge 222 may not be required for determining the actuation points 902, 904, 906, 908. The computing device 400 may determine the actuation points 902, 904, 906, 908 based on the strain signal 900 providing a characterization of the loading and unloading of the strain in the chamber 206. Although the actuation points 902, 904, 906, 908 are identified using a strain signal, the valve actuation may be determined using other measurements, including but not limited to, pressure measurements as known in art.

Figure 10:
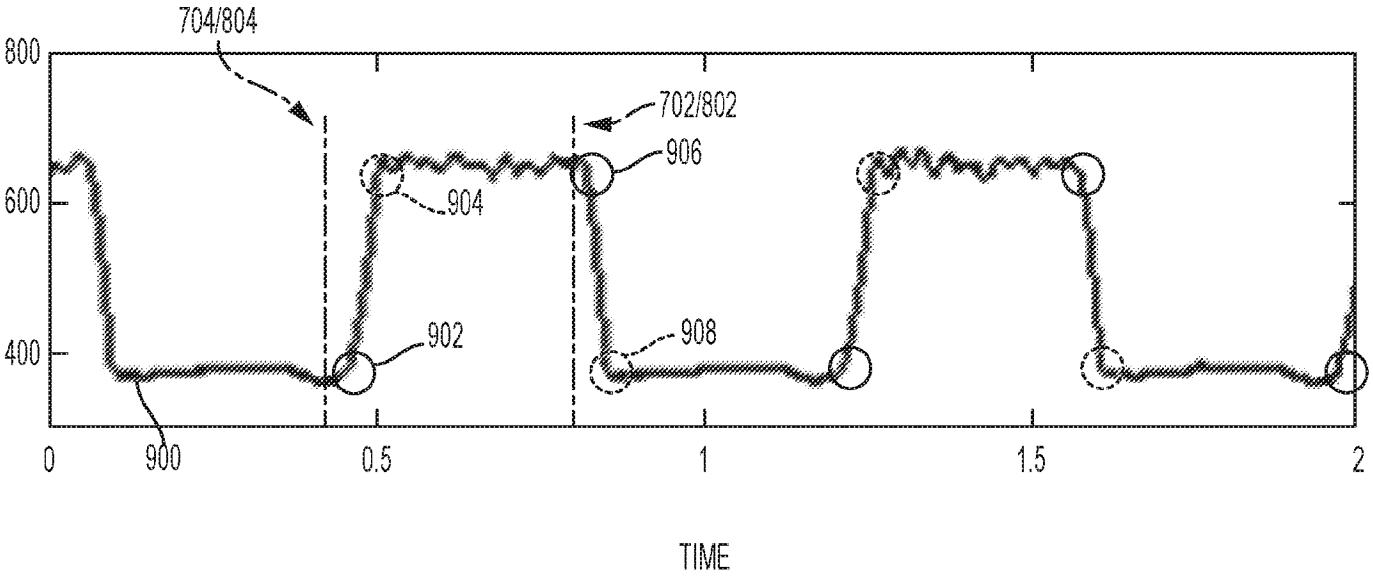
FIG. 10 is a signal graph depicting actuation delays of a suction valve and a discharge valve of a pressure pump of FIG. 1 according to one aspect of the present disclosure.

Returning to FIG. 6, in block 608, actuation delays for the valves 216, 218 may be determined using the actuation points 902, 904, 906, 908 and the plunger position. FIG. 10 shows the actuation delays for the valves 216, 218 according to one aspect of the present disclosure. In FIG. 10, the strain signal 900 of FIG. 10 with the actuation points 902, 904, 906, 908 of the valves 216, 218 shown relative to the position of the plunger 214. The actuation points 902, 904 are shown relative to the plunger 214 positioned at the bottom dead center (represented by reference points 704, 804) for closure of the suction valve 216 and opening of the discharge valve 218. The actuation points 906, 908 are shown relative to the plunger 214 positioned at top dead center (represented by reference points 702, 802) for opening of the suction valve 216 and closing of the discharge valve 218. The time distance between the actuation points 902, 904, 906, 908 of the valves 216, 218 and the plunger-position reference points 702, 704 802, 804 may represent the actuation delays of the valves 216, 218. For example, the time between the closing of the suction valve 216 (represented by actuation point 902) or the opening of the discharge valve 218 (represented by the actuation point 904) and the bottom dead center of the plunger 214 (represented by reference points 704, 804) may represent compression delays in the actuation of the valves 216, 218. The time between the closing of the discharge valve 218 (represented by actuation point 906) or the opening of the suction valve 216 (represented by actuation point 908) and the top dead center of the plunger 214 (represented by reference points 702, 804) may represent decompression delays in the actuation of the valves 216, 218. In some aspects, the delays in the actuation of the valves 216, 218 may correspond to the volume of fluid entering or exiting the chamber 206 as the plunger enters and regresses from the chamber 206. For example, in normal conditions, during compression of the pressure pump 100, as the plunger 214 regresses from the chamber 206, fluid will enter the chamber 206 to replace the position of the plunger 214. The fluid may continue to enter until the suction valve 216 closes at actuation point 902 and the discharge valve 218 opens at actuation point 904 to allow fluid to be discharged from the chamber 206. The actuation delays may correspond to the volume of fluid entering and exiting the chamber 206 through the valves 216, 218, resulting in incomplete fills of the chamber 206 during each stroke of the plunger 214. In some aspects, the actuation delays may correspond to cavitation in the chamber 206 where at least a portion of the position of the plunger 214 is displaced with air instead of fluid.

Figure 11:
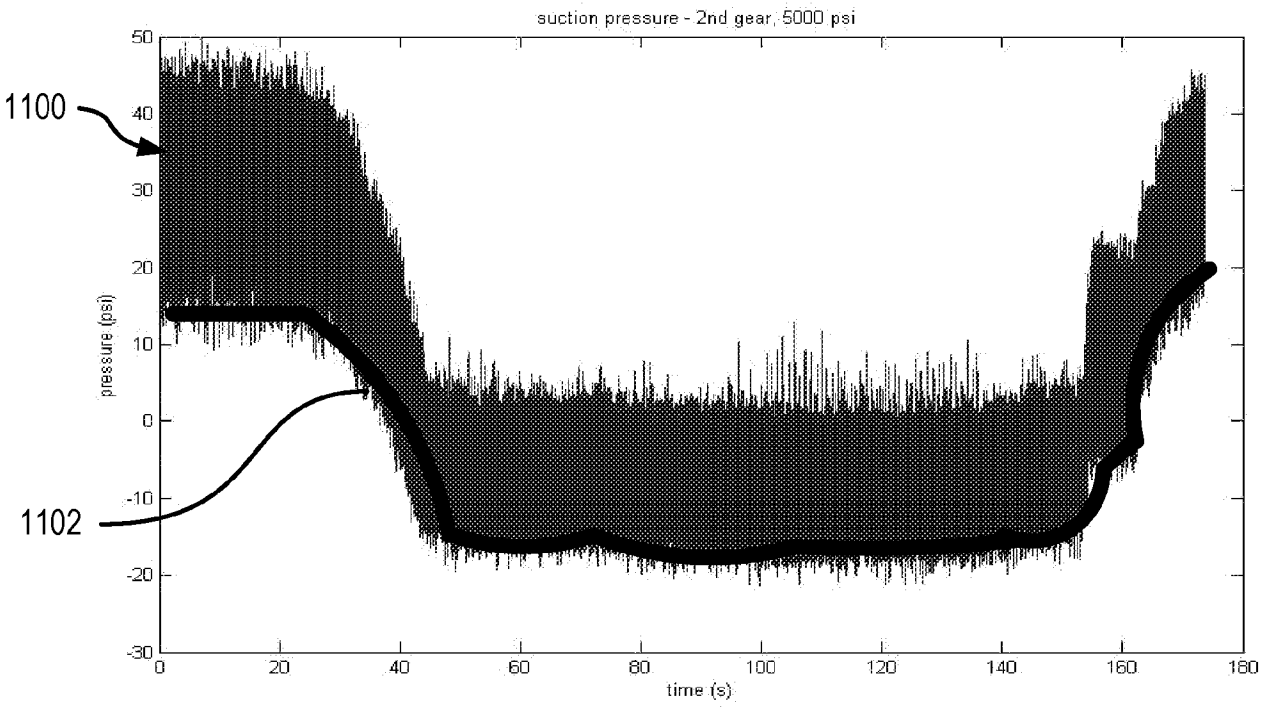
FIG. 11 is a signal graph depicting a signal generated by a boost pressure of the monitoring system of FIG. 4 according to one aspect of the present disclosure.

FIG. 11 shows an example of a pressure signal 1100 representing boost pressure at the inlet of the chamber 206 as described in block 502 of FIG. 5. In some aspects, the pressure signal 1100 may be generated by the pressure transducer 224 positioned at proximate to the inlet of the chamber 206. As shown, by the pressure signal 1100 the boost pressure may be erratic, causing the pressure signal 1100 to be intervaled peaks. The pressure transducer 224 may include an enveloping filter that may determine a minimum boost pressure 1102 by ramping down the pressure signal 1100 and slowly increasing to trace the lower peaks of the pressure signal 1100. In some aspects, the enveloping filter may be included in or accessible to the processor 402 of the computing device 400 instead of included in the pressure transducer 224. The envelope filter may be a digital or analog filter.

Figure 12:
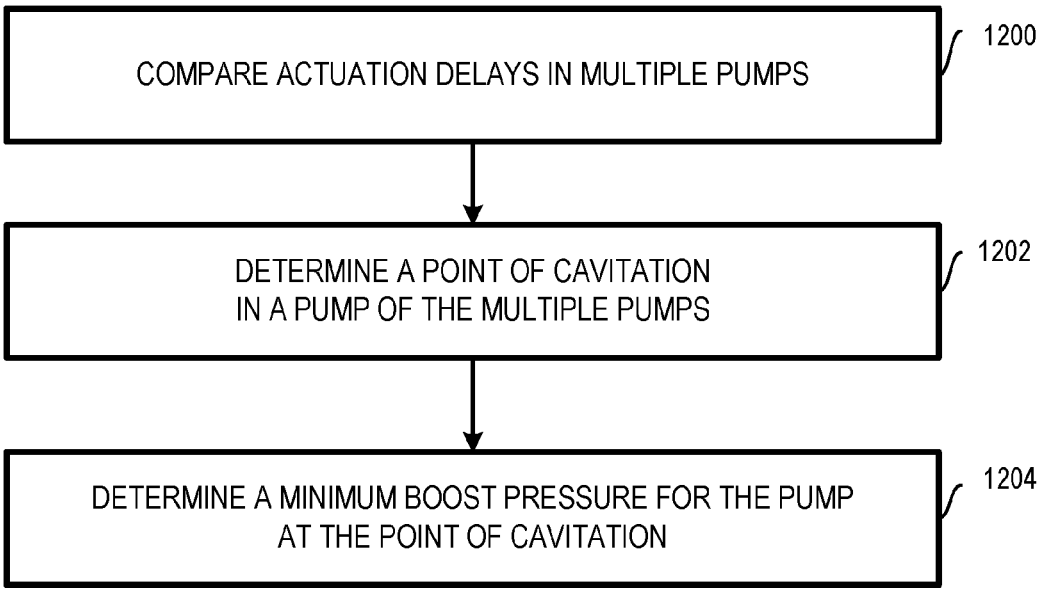
FIG. 12 is a flow chart of an example of determining boost pressure of a pump at a point of cavitation according to one aspect of the present disclosure.

FIG. 12 is a flow chart of a process for using the actuation delays and the minimum boost pressure 1102 to determine the cavitation threshold.

In block 1200, the actuation delays for each pump 100, 102, 104 are compared. In some aspects, a comparison of the actuation delays of each pump 100, 102, 104 may indicate whether cavitation is present in one of the pumps. For example, in some aspects, the actuation delays corresponding to the compression side of the pump 100 (e.g., the delays in the actuation points 900, 902 representing the suction valve 216 closing and the discharge valve 218 opening) may be compared to determine cavitation in the chamber 206. In some aspects, deviations in the timing between the actuation of the same types of valves in each pump 100, 102, 104 on the compression side of the pumps 100, 102, 104 may indicate cavitation in the chamber. On the compression side, the deviations may indicate that the suction valves 216 are closing at different times in each of the chambers 206 of the pressure pump represented by the compression actuation delays. The deviations may similarly indicate that the discharge valves 218 are opening at different times in each of the chambers 206. In some aspects, cavitation may be confirmed by comparing the actuation delays corresponding to the decompression side of the pumps 100, 102, 104. For example, where deviations occur on the compression side, but do not occur on the decompression side corresponding to the opening of the suction valves 216 or the closing of the discharge valves 218, cavitation likely exists.

Figure 13:
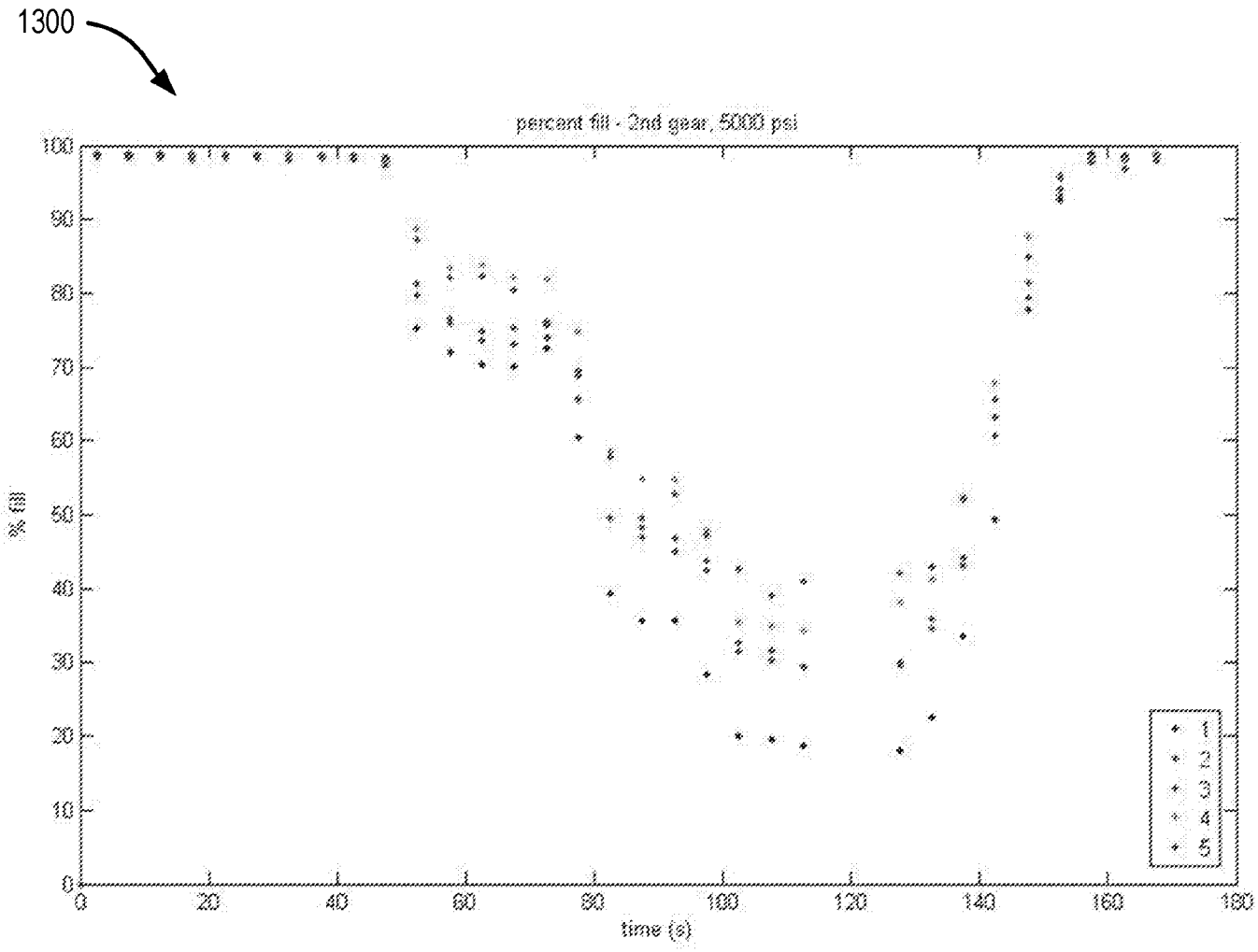
FIG. 13 is a plot graph depicting an example of a comparison of the actuation delays of FIG. 10 for multiple pumps sections according to one aspect of the present disclosure.

FIG. 13 shows a plot graph 1300 including plot points representing the actuation delays for the suction valve 216 of a set of pressure pump sections having five chambers 206, collectively. The actuation delays are represented in terms to a fill-percentage of each chamber 206 over time. The plot points indicate that the pressure pumps normally operate at a 98% fill of the respective chambers 206.

Returning to FIG. 12, in block 1202, a point of cavitation in a pump is determined. In some aspects, the point of cavitation may correspond to the time at which cavitation is identified in the chamber 206 of a pressure pump 100, 102, 104. Returning to the plot graph 1300 in FIG. 13, at approximately 50 seconds, an incomplete fill of the chambers 206 is shown. Based on the trend of the plot points of the plot graph 1300, the point of cavitation may be determined at 50 seconds. The degree of fill may vary after 50 seconds for each chamber 206 due to variances in the flow paths to each pressure pump section corresponding to the chambers 206, though the presence of cavitation and the relative severity of the cavitation may be indicated by the relative deviations of fill percentages over time. For example, the plot points representing the actuation delays for chambers 1-4 appear to remain a consistent distance from each other on the y-axis of the plot graph 1300. But, the plot points representing the actuation delays for chamber 5 deviate from the trend of the plot points for the other chambers. This deviation may indicate cavitation in chamber 5 starting at approximately 50 seconds.

Returning to FIG. 12, in block 1204, a minimum boost pressure of the pump at the point of cavitation is determined. In some aspects, the pressure signal 1100 of FIG. 11 and the plot graph 1300 of FIG. 13 may be correlated to determine the minimum boost pressure at the point of cavitation. For example, correlating the pressure signal 1100 and the plot graph 1300 may include comparing the two over the same interval of time to determine the boost pressure over the time the plot graph 1300 indicates cavitation in the chamber 206. For example, based on the minimum boost pressure 1102 for the pressure signal 1100, the minimum boost point at 50 seconds (the point of cavitation determined in block 1200) is approximately −10 pounds per square inch (psi). In some aspects, the point of cavitation may be designated as the cavitation threshold for the corresponding pressure pump 100, 102, 104. In other examples, the cavitation threshold may be determined based on a predetermined range from the point of cavitation (e.g., within 5 psi of the point of cavitation). In some aspects, the point of cavitation or the cavitation threshold may be stored as pump data 410 by the computing device 400 of each pump, or as data 420 by the controller 120.

Figure 14:
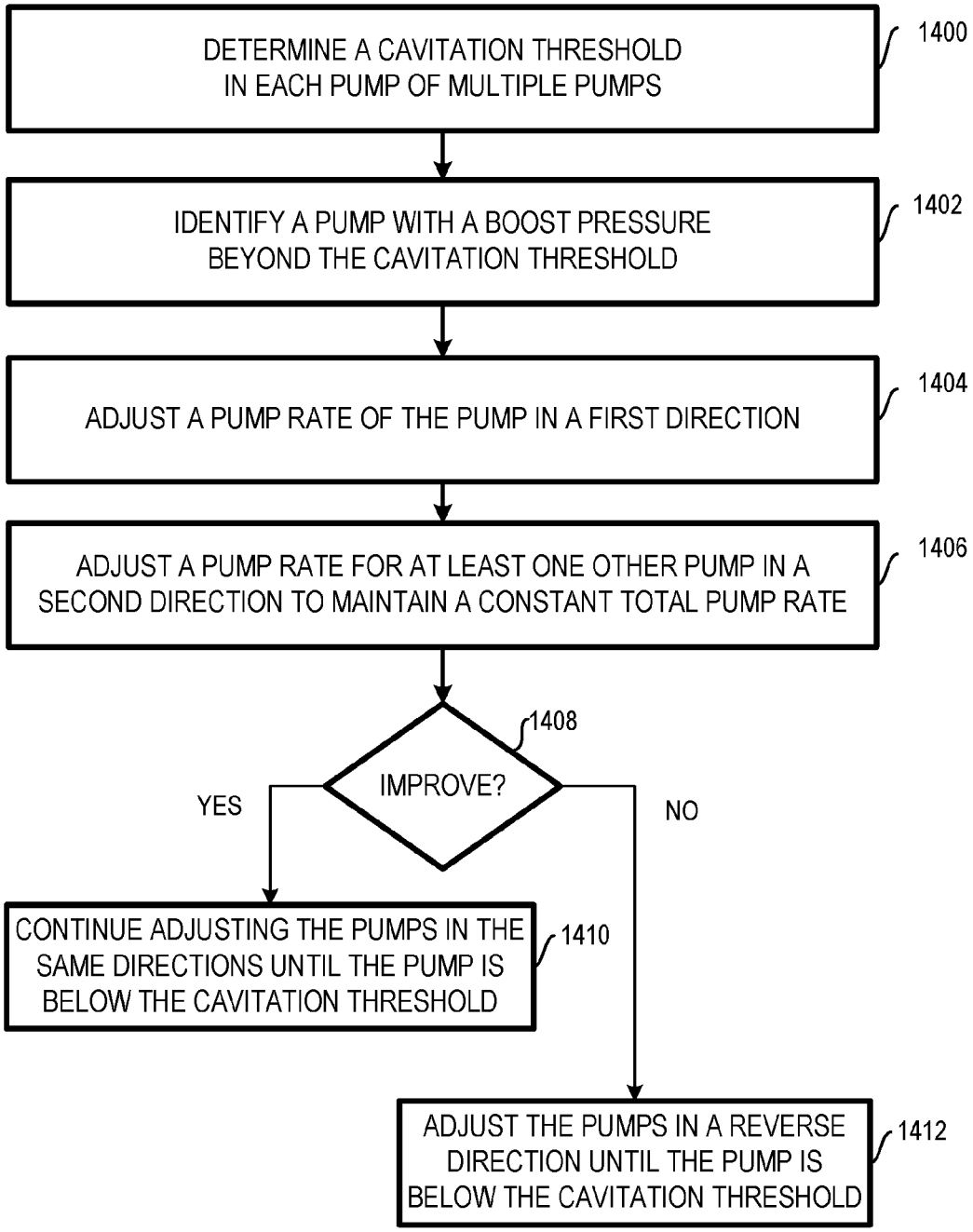
FIG. 14 is a flow chart of an example of a process for avoiding cavitation in a pressure pump according to one aspect of the present disclosure.

FIG. 14 is a flow chart of an example of a process for avoiding cavitation in a pressure pump according to one aspect of the present disclosure. The process may be described with respect to each of the proceeding figures, though other implementations are possible without departing from the scope of the present disclosure.

In block 1400, a cavitation threshold is determined for each of multiple pumps 100, 102, 104. The threshold for each pump may be determined as described in FIG. 5.

In block 1402, a pump is identified as having a boost pressure beyond the cavitation threshold. For example, during operation of the pumps 100, 102, 104, the controller 120 or the computing device 400 may monitor the boost pressure of each pump 100, 102, 104. The controller 120 or the computing device 400 may determine that a pump 100 is approaching the point of cavitation, or is with a predetermined range of the point of the cavitation designated as the cavitation threshold. In some aspects, the controller 120 may retrieve the cavitation threshold from the data 420 of the memory 416. In other aspects, the controller 120 may receive the cavitation threshold for the computing device 400 corresponding to the pump 100, 102, 104. In further aspects, the computing device 400 may retrieve the cavitation threshold for the pump from the pump data 410.

In block 1404, the pump rate of the pump 100, 102, 104 identified as operating beyond the cavitation threshold is adjusted. In some aspects, the pump rate may be adjusted by the computing device 400. In additional aspects, the pump rate may be adjusted in response to a control signal received from the controller 120. The pump rate may correspond to rate necessary to change the rate of fluid flowing through the pump. For example, in FIG. 3, the flow rate through the pump 100 is $F_{AB}$, the flow rate through the pump 102 is $F_{BC}$, and the flow rate through the pump 104 is $F_{EF}$. Adjusting the pump rate for the pumps 100, 102, 104 may adjust the corresponding flow rate in the same direction. In some aspects, the pump rate of the pump 100, 102, 104 operating beyond the cavitation threshold may be increased. In other aspects, the pump rate may be decreased.

Returning to block 1406, the pump rate of one or more other pumps 100, 102, 104 is adjusted in an opposite direction. For example, if the pump 100 is identified as operating beyond the cavitation threshold, the pump rate for the pump 100 may be increased to increase the flow rate, $F_{AB}$, through the pump 100 in an effort to decrease or stop the cavitation in the chamber 206 of the pump 100. The pump rates of one or both of the pumps 102, 104 may be decreased to maintain the flow rate $F_1$ into and out of the manifold trailer of FIG. 3. In some aspects, the pump 100, 102, 104 adjusted in the opposite direction of the adjustment to the cavitating chamber may be identified using the minimum boost pressure 1102 corresponding to the chamber of the adjusted pump 100, 102, 104. Returning to the example where pump 100 is identified as operating beyond the cavitation threshold (e.g., the chamber corresponding to the pump 100 is cavitating as indicated by the fill percentage shown in FIG. 13), a determination may be made as to which of pumps 102, 104 to adjust based on the minimum boost pressure 1102. The minimum boost pressure 1102 indicates how far the pump (or respective chamber of the pump) is from the cavitation threshold. As such, the chamber operating farthest from the cavitation threshold may have more capacity for a rate adjustment than a chamber operating closer to the cavitation threshold. The minimum boost pressure 1102 indicating that the chamber 106 of pump 102 is farther from the cavitation threshold than that of pump 104 may cause pump 102 to be adjusted to compensate for the cavitation in the chamber 106 of pump 100.

In 1408, the controller 130 or the computing device 400 may monitor the pump identified in block 1402 to determine if conditions in the pump have improved in response to adjusting the pump rates. In block 1410, in response to determining that the conditions are improving to reduce or stop cavitation, or move below the threshold, the pumps may be continued to be adjusted in the same directions, and monitored, until the identified pump is no longer beyond the cavitation threshold. For example, the pump rate of pump 100 may be increased and the pump rate of pump 104 may be decreased to compensate for the increase in the pump rate of the pump 100. Upon determining improvement, the controller 120 may continue to decrease the pump rate of pump 100 and increase the pump rate of pump 104 until cavitation is no longer present.

In block 1412, in response to determining that conditions in the pump have not improved in response to adjusting the pump, the controller 120 or the computing device 400 may adjust the identified pump in the opposite direction. For instance, a pump 100 positioned closest to the inlet of the manifold may a chamber 206 with cavitation due to a high velocity stream of fluid passing by the joint A to supply fluid to the other pumps 102, 104 positioned downstream. The high velocity passing by joint A may create a vacuum or reduced pressure, which requires a decrease in the flow rate $F_{AB}$ through the pump 100. Returning to the example of block 1410, subsequent to increasing the pump rate of the pump 100 and decreasing the pump rate of the pump 104, the controller 120 or the computing device 400 may decrease the pump rate of the pump 100 and increase the pump rate of the pump 104.

In some aspects, monitoring systems and methods may be used according to one or more of the following examples:

Example 1

A monitoring system may include a plurality of strain gauges positionable on a plurality of pressure pumps to generate strain measurements for the plurality of pressure pumps. The monitoring system may also include a plurality of position sensors positionable on the plurality of pressure pumps to generate position measurements for rotating members of the plurality of pressure pumps. The monitoring system may also include a plurality of pressure transducers positionable on the plurality of pressure pumps to generate boost pressure measurements in a fluid ends of the plurality of pressure pumps, the boost measurements being usable with the strain measurement and the position measurement to determine a cavitation threshold of each pump of the plurality of pressure pumps.

Example 2

The monitoring system of example 1 may also include a computing device communicatively couplable to the plurality of strain gauges, the plurality of position sensors, and the plurality of pressure transducers to transmit a control signal to a pump of the plurality of pressure pumps operating beyond the cavitation threshold, the control signal corresponding to a first instruction to adjust a first pump rate of the pump in a first direction.

Example 3

The monitoring system of examples 1-2 may feature the computing device including a processing device for which instructions are executable by the processor to cause the processing device to maintain a total flow rate of fluid through the plurality of pressure pumps by determining a corresponding adjustment to one or more pumps rates of one or more additional pumps of the plurality of pressure pumps in an opposing direction that is opposite to the first direction.

Example 4

Example 3: The monitoring system of examples 1-3 may feature a processing device for which instructions are executable by the processor to cause the processing device to identify a second pump of the one or more additional pumps based on the boost measurement of the second pump and adjust a corresponding pump rate of the second pump in the opposing direction to maintain the total flow rate through the plurality of pressure pumps, wherein the boost measurement of the second pump indicates that the second pump is farthest below the cavitation threshold.

Example 5

Example 3: The monitoring system of examples 1-4 may feature the computing device including a processing device for which instructions are executable by the processor to cause the processing device to, subsequent to transmitting the control signal and determining an undesirable change in response to adjusting the first pump rate in the first direction to an adjusted pump rate, transmit a second control signal to a corresponding processing device of the pump, the second control signal corresponding to a second instruction to adjust the adjusted pump rate of the pump in an opposing direction that is opposite to the first direction.

Example 6

Example 3: The monitoring system of examples 1-5 may also include one or more computing devices communicatively coupled to a pump of the plurality of pressure pumps. The one or more computing devices may include at least one processing device for which instructions are executable by the processor to cause the at least one processing device to determine the cavitation threshold for the pump by (1) determining actuation points for a valve of a chamber of the pump using the strain measurement for a chamber of the pump, (2) determining a position of a displacement member mechanically coupled to the rotating member of the pump using the position measurement for the rotating member of the pump, (3) determining actuation delays corresponding to the valve by correlating the actuation points of the valve and the position of the displacement member, (4) determining a minimum boost pressure of the pump at an inlet to the chamber of the pump based on the boost measurement of the fluid end of the pump, and (5) determining a cavitation boost pressure corresponding to the minimum boost pressure when cavitation is present in the pump using the actuation delays.

Example 7

The monitoring system of examples 1-6 may feature the at least one processing device including instructions executable by the processing device for causing the processing device to determine when the cavitation boost pressure by (1) comparing the actuation delays to additional actuation delays corresponding to additional pumps of the plurality of pressure pumps, (2) determining a point of cavitation in the pump by identifying deviations in the actuation delays for the pump from a trend of the additional actuation delays of the additional pumps, and (3) comparing the point of cavitation to the minimum boost pressure to determine the minimum boost pressure of the pump at the point of cavitation.

Example 8

The monitoring system of examples 1-7 may feature a pressure transducer of the plurality of pressure transducers including an enveloping filter to determine the minimum boost pressure of the pump by tracing lower peaks of a pressure signal corresponding to the boost pressure measurement for the pump.

Example 9

The monitoring system of examples 1-8 may feature the plurality of pumps positioned in parallel between an intake manifold and an outlet manifold that is fluidly couplable to a wellbore to inject fluid from the plurality of pressure pumps into the wellbore to fracture a subterranean formation positioned adjacent to the wellbore.

Example 10

A method may include determining, by one or more processors, actuation delays for one or more valves in each pump of a plurality of pressure pumps using strain measurements of strain in the plurality of pressure pumps and position measurements for rotating members of the plurality of pressure pumps. The method may also include determining, by the one or more processors, minimum boost pressures for the plurality of pressure pumps. The method may also include determining, by one or more processors, a cavitation threshold for each pump of the plurality of pressure pumps using the actuation delays and the minimum boost pressures.

Example 11

The method of example 10 may feature determining the actuation delays for the one or more valves of the plurality of pressure pumps to include, for at least one pump of the plurality of pressure pumps (1) receiving, from a position sensor, a position signal representing the position measurement for the at least one pump, (2) receiving, from a strain gauge, a strain signal representing the strain measurement for a chamber of the at least one pump, (3) determining a position of a displacement member mechanically coupled to the rotating member using the position signal, (4) determining actuation points of a valve of the chamber, and (5) correlating the position of the displacement member and the actuation points of the valve to determine the actuation delays for the at least one pump.

Example 12

The method of examples 10-11 may feature determining a minimum boost pressure for a pump of the plurality of pumps to include tracing low peaks of a pressure signal generated by a pressure transducer coupled to an inlet of a chamber of the pump.

Example 13

The method of examples 10-12 may feature determining the cavitation threshold for each pump to include, for at least one pump of the plurality of pressure pumps (1) comparing the actuation delays of the at least one pump with additional actuation delays for additional pumps of the plurality of pumps, (2) determining a point of cavitation in the at least one pump based on the actuation delays, and (3) determining the minimum boost pressure for the at least one pump at the point of cavitation.

Example 14

The method of examples 10-13 may also include identifying, by the one or more processors, a pump of the plurality of pumps having a boost pressure beyond the cavitation threshold determined for the pump. The method may also include adjusting, by the one or more processors, a pump rate of the pump in a first direction. The method may also include maintaining, by the one or more processors, a total pump rate of the plurality of pressure pumps. The method may also include determining a change in the boost pressure for the pump in response to adjusting the pump rate to an adjusted pump rate.

Example 15

The method of examples 10-14 may feature maintaining the total pump rate of the plurality of pressure pumps to include adjusting a second pump rate of a second pump of the plurality of pump in a second direction opposite the first direction.

Example 16

The method of examples 10-15 may feature adjusting the second pump rate of the second pump in a second direction to include identifying the second using a second boost pressure corresponding to the second pump.

Example 17

The method of examples 10-16 may also include, in response to determining an undesirable change in the boost pressure for the pump at the adjusted pump rate, adjusting, by the one or more processors, the adjusted pump rate in a second direction opposite the first direction.

Example 18

A system may include a plurality of pressure pumps positioned between an intake manifold and an output manifold, each pump of the plurality of pumps including a fluid chamber positionable in a fluid end of each pump and including a valve to control a flow of fluid through each pump, each pump having a strain in the fluid chamber being measurable by a strain gauge and a boost pressure proximate to the valve being measurable by a pressure transducer. Each pump may also include a rotating member positionable in a power end of each pump to control movement of a displacement member in the fluid chamber, a position of the rotating member being measurable by a position sensor. The system may also include one or more computing devices communicatively coupled to plurality of pressure pumps to identify a cavitation threshold representing a boost pressure measurement indicative of potential cavitation for each pump of the plurality of pumps using a position measurement generated by the position sensor, a strain measurement generated by the strain gauge, and a pressure measurement generated by the pressure transducer.

Example 19

The system of example 18 may feature the one or more computing devices includes at least one processing device for which instructions are executable by the at least one processing device to cause the at least one processing device to (1) determine, for each pump of the plurality of pumps, actuation delays for the valve using a strain measurement generated by the strain gauge and a position measurement generated by the position sensor, (2) determine, for each pump, a minimum boost pressure proximate to the valve, and (3) determine, for each pump, the cavitation threshold by using the actuation delays and the minimum boost pressure to identify the minimum boost pressure at a point of cavitation for each pump.

Example 20

The system of examples 18-19 may feature the one or more computing devices including at least one processing device for which instructions are executable by the at least one processing device to cause the at least one processing device to (1) identify a pump of the plurality of pressure pumps having a boost pressure beyond the cavitation threshold, (2) adjust a first pump rate of the pump in a first direction, and (3) adjust a second pump rate of another pump of the plurality of pressure pumps in a second direction that is opposite the first direction to maintain a constant total pump rate for the plurality of pressure pumps into the intake manifold and out of the output manifold.

The foregoing description of the examples, including illustrated examples, has been presented only for the purpose of illustration and description and is not intended to be exhaustive or to limit the subject matter to the precise forms disclosed. Numerous modifications, combinations, adaptations, uses, and installations thereof can be apparent to those skilled in the art without departing from the scope of this disclosure. The illustrative examples described above are given to introduce the reader to the general subject matter discussed here and are not intended to limit the scope of the disclosed concepts.

What is claimed is:

1. A monitoring system, comprising:

a plurality of strain gauges positioned on a plurality of pressure pumps to generate strain measurements for chambers of the plurality of pressure pumps;

a plurality of position sensors positioned on the plurality of pressure pumps to generate position measurements for rotating members of the plurality of pressure pumps;

a plurality of pressure transducers positioned on the plurality of pressure pumps to generate boost pressure measurements associated with fluid ends of the plurality of pressure pumps; and a computing device including a processor and a memory, the memory including instructions that are executable by the processor for causing the processor to:

determine a cavitation threshold of each pump of the plurality of pressure pumps based on the strain measurements, the position measurements, and the boost pressure measurements;

identify a first pump of the plurality of pressure pumps operating beyond the cavitation threshold;

transmit a first control signal for causing a pump rate of the first pump to be adjusted in a first direction;

identify a second pump of the of the plurality of pressure pumps based on the boost pressure measurement of the second pump, wherein the boost pressure measurement of the second pump indicates that the second pump is farthest below the cavitation threshold as compared to a remainder of the pressure pumps in the plurality of pressure pumps; and transmit a second control signal for causing a pump rate of the second pump to be adjusted in an opposing direction that is opposite to the first direction, to maintain a total flow rate through the plurality of pressure pumps.

2. The monitoring system of claim 1, further comprising the computing device being communicatively coupled to the plurality of strain gauges, the plurality of position sensors, and the plurality of pressure transducers.

3. The monitoring system of claim 2, wherein the memory further includes instructions that are executable by the processor to cause the processor to determine the adjustment to be made to the pump rate of the second pump.

4. The monitoring system of claim 1, wherein the memory further includes instructions that are executable by the processor to cause the processor to:

subsequent to transmitting the first control signal and determining an undesirable change in response to adjusting the first pump rate in the first direction to an adjusted pump rate, transmit a third control signal configured for causing the adjusted pump rate of the first pump to be adjusted in the opposing direction that is opposite to the first direction.

5. The monitoring system of claim 1, wherein the memory further includes instructions that are executable by the processor to cause the processor to determine the cavitation threshold for a respective pump of the plurality of pressure pumps by:

determining actuation points for a valve of a chamber of the pump using the strain measurement for the chamber of the pump;

determining a position of a displacement member mechanically coupled to the rotating member of the pump using the position measurement for the rotating member of the pump;

determining actuation delays corresponding to the valve by correlating the actuation points of the valve and the position of the displacement member;

determining a minimum boost pressure of the pump at an inlet to the chamber of the pump based on the boost pressure measurement of the fluid end of the pump; and determining a cavitation boost pressure corresponding to the minimum boost pressure when cavitation is present in the pump using the actuation delays.

6. The monitoring system of claim 5, wherein the memory further includes instructions that are executable by the processor for causing the processor to determine the cavitation boost pressure of the respective pump by:

comparing the actuation delays to additional actuation delays corresponding to additional pumps of the plurality of pressure pumps;

determining a point of cavitation in the pump by identifying deviations in the actuation delays for the pump from a trend of the additional actuation delays of the additional pumps; and comparing the point of cavitation to the minimum boost pressure to determine the minimum boost pressure of the pump at the point of cavitation.

7. The monitoring system of claim 5, wherein a pressure transducer of the plurality of pressure transducers includes an enveloping filter to determine the minimum boost pressure of the respective pump by tracing lower peaks of a pressure signal corresponding to the boost pressure measurement for the pump.

8. The monitoring system of claim 1, wherein the plurality of pressure pumps are positioned in parallel between an intake manifold and an outlet manifold, wherein the outlet manifold is fluidly couplable to a wellbore to inject fluid from the plurality of pressure pumps into the wellbore to fracture a subterranean formation positioned adjacent to the wellbore.

9. A method, comprising:

determining, by one or more processors, actuation delays for one or more valves in each pump of a plurality of pressure pumps using strain measurements of strain in the plurality of pressure pumps and position measurements for rotating members of the plurality of pressure pumps;

determining, by the one or more processors, minimum boost pressures for the plurality of pressure pumps;

determining, by the one or more processors, a cavitation threshold for each pump of the plurality of pressure pumps using the actuation delays and the minimum boost pressures;

identifying, by the one or more processors, a pump of the plurality of pressure pumps having a boost pressure beyond the cavitation threshold determined for the pump; and adjusting, by the one or more processors, a pump rate of the pump.

10. The method of claim 9, wherein determining the actuation delays for the one or more valves of the plurality of pressure pumps includes, for a respective pump of the plurality of pressure pumps:

receiving, from a position sensor, a position signal representing the position measurement for the pump;

receiving, from a strain gauge, a strain signal representing the strain measurement for a chamber of the pump;

determining a position of a displacement member mechanically coupled to the rotating member of the pump using the position signal;

determining actuation points of a valve of the chamber; and correlating the position of the displacement member and the actuation points of the valve to determine the actuation delays for the pump.

11. The method of claim 9, wherein determining the minimum boost pressure for a respective pump of the plurality of pressure pumps includes tracing low peaks of a pressure signal generated by a pressure transducer coupled to an inlet of a chamber of the pump.

12. The method of claim 9, wherein determining the cavitation threshold for each pump includes, for a respective pump of the plurality of pressure pumps:

comparing the actuation delays of the pump with additional actuation delays for additional pumps of the plurality of pressure pumps;

determining a point of cavitation in the pump based on the actuation delays; and determining the minimum boost pressure for the pump at the point of cavitation.

13. The method of claim 9, further comprising:

adjusting, by the one or more processors, the pump rate of the pump in a first direction;

maintaining, by the one or more processors, a total pump rate of the plurality of pressure pumps; and determining, by the one or more processors, a change in the boost pressure for the pump in response to adjusting the pump rate to an adjusted pump rate.

14. The method of claim 13, wherein maintaining the total pump rate of the plurality of pressure pumps includes adjusting a pump rate of a second pump of the plurality of pressure pumps in a second direction that is opposite to the first direction.

15. The method of claim 14, wherein adjusting the pump rate of the second pump in the second direction includes identifying the second pump using a second boost pressure corresponding to the second pump.

16. The method of claim 13, further comprising:

in response to determining an undesirable change in the boost pressure for the pump at the adjusted pump rate, adjusting, by the one or more processors, the adjusted pump rate in a second direction that is opposite the first direction.

17. A system, comprising:

a plurality of pressure pumps positioned between an intake manifold and an output manifold, each pump of the plurality of pressure pumps including:

a fluid chamber positioned in a fluid end of the pump and including a valve to control a flow of fluid through the pump;

a strain gauge configured to measure strain in the fluid chamber;

a pressure transducer configured to measure a boost pressure proximate to the valve;

a rotating member positioned in a power end of the pump to control movement of a displacement member in the fluid chamber; and a position sensor configured to measure a position of the rotating member; and one or more computing devices communicatively coupled to the plurality of pressure pumps, the one or more computing devices including one or more processors and one or more non-transitory computer-readable mediums, the one or more non-transitory computer-readable mediums including instructions that are executable by the one or more processors for causing the one or more processors to:

determine actuation delays for the valve in each pump of the plurality of pressure pumps using a position measurement generated by the position sensor, a strain measurement generated by the strain gauge, and a pressure measurement generated by the pressure transducer;

identify a cavitation threshold for each pump of the plurality of pressure pumps based on the actuation delays;

identify a pump of the plurality of pressure pumps having a boost pressure beyond the respective cavitation threshold of the pump; and adjust a pump rate of the pump.

18. The system of claim 17, wherein the one or more non-transitory computer-readable mediums further includes instructions that are executable by the one or more processors for causing the one or more processors to:

determine, for each pump, a minimum boost pressure proximate to the valve; and determine, for each pump, the cavitation threshold by using the actuation delays and the minimum boost pressure to identify the minimum boost pressure at a point of cavitation for each pump.

19. The system of claim 17, wherein the one or more non-transitory computer-readable mediums further includes instructions that are executable by the one or more processors for causing the one or more processors to:

adjust the pump rate of the pump in a first direction; and adjust a pump rate of another pump of the plurality of pressure pumps in a second direction that is opposite the first direction to maintain a constant total pump rate for the plurality of pressure pumps into the intake manifold and out of the output manifold.

20. A system comprising:

a plurality of strain gauges positioned on a plurality of pressure pumps to generate strain measurements for the plurality of pressure pumps;

a plurality of position sensors positioned on the plurality of pressure pumps to generate position measurements for rotating members of the plurality of pressure pumps;

a plurality of pressure transducers positioned on the plurality of pressure pumps to generate boost pressure measurements associated with fluid ends of the plurality of pressure pumps; and a computing device including a processor and a memory, the memory including instructions that are executable by the processor for causing the processor to:

determine a cavitation threshold of each pump based on the strain measurements, the position measurements, and the boost pressure measurements;

identify a pump of the plurality of pressure pumps operating beyond the respective cavitation threshold of the pump;

transmit a first control signal configured to cause a pump rate of the pump to be adjusted in a first direction;

subsequent to transmitting the first control signal, determine an undesirable change resulting from adjusting the pump rate in the first direction to an adjusted pump rate; and subsequent to determining the undesirable change, transmit a second control signal configured to cause the adjusted pump rate of the pump to be adjusted in a second direction that is opposite to the first direction.

* * * * *